US011236975B2

(12) United States Patent
Biard et al.

(10) Patent No.: US 11,236,975 B2
(45) Date of Patent: Feb. 1, 2022

(54) WIRELESS ELECTRONIC DETONATOR

(71) Applicants: Commissariat A L'Energie Atomique et Aux Energies Alternatives, Paris (FR); Davey Bickford, Hery (FR)

(72) Inventors: Lionel Biard, Coublevie (FR); Ghislain Despesse, Voreppe (FR); Franck Guyon, Auxerre (FR)

(73) Assignees: COMMISSARIAT A L'ENERGIE ATOMIQUE ET AUX ENERGIES ALTERNATIVES, Paris (FR); Davey Bickford, Hery (FR)

( * ) Notice: Subject to any disclaimer, the term of this patent is extended or adjusted under 35 U.S.C. 154(b) by 121 days.

(21) Appl. No.: 16/753,103

(22) PCT Filed: Oct. 4, 2018

(86) PCT No.: PCT/FR2018/052452

§ 371 (c)(1),
(2) Date: Apr. 2, 2020

(87) PCT Pub. No.: WO2019/073148

PCT Pub. Date: Apr. 18, 2019

(65) Prior Publication Data

US 2020/0278187 A1 Sep. 3, 2020

(30) Foreign Application Priority Data

Oct. 9, 2017 (FR) ..... 1759416

(51) Int. Cl.
*F42D 1/055* (2006.01)
*F42D 5/00* (2006.01)
(Continued)

(52) U.S. Cl.
CPC ..... *F42B 3/121* (2013.01); *F42B 3/12* (2013.01); *F42D 1/055* (2013.01); *F42D 5/00* (2013.01);
(Continued)

(58) Field of Classification Search
CPC ..... F42C 15/40; F42C 15/42; F42C 11/00; F42C 11/001; F42C 11/002; F42C 11/008;
(Continued)

(56) References Cited

U.S. PATENT DOCUMENTS 7,464,648 B2 * 12/2008 Teowee ..... F42C 15/188 102/254
7,810,430 B2 * 10/2010 Chan ..... F42B 3/113 102/206
(Continued)

FOREIGN PATENT DOCUMENTS

FR 3046222 A1 * 6/2017 ..... F42D 1/045
WO WO-2017083885 A1 * 5/2017 ..... F42C 13/04

*Primary Examiner* — James S Bergin
(74) *Attorney, Agent, or Firm* — Crowell & Moring LLP

(57) ABSTRACT

A wireless electronic detonator includes an energy source and functional modules. A first switching switch is provided between the energy source and the functional modules, making it possible to connect or not connect the energy source to the functional modules. A control module for controlling the first switching means includes a module for recovering radio energy configured to receive a radio signal from a control console, to recover the electric energy in the radio signal received, to generate an energy recovery signal (VRF) representative of the level of electric energy recovered, and to generate as output a control signal (VOUT) as a function of the recovered energy, the control signal controlling the first switch.

25 Claims, 11 Drawing Sheets

(51) Int. Cl.

| | |
|---|---|
| ***F42B 3/12*** | (2006.01) |
| ***F42C 13/04*** | (2006.01) |
| ***F42C 15/42*** | (2006.01) |
| ***F42C 11/00*** | (2006.01) |
| *F42B 3/10* | (2006.01) |

(52) U.S. Cl.
CPC ..... *F42B 3/10* (2013.01); *F42C 11/008* (2013.01); *F42C 13/04* (2013.01); *F42C 15/42* (2013.01)

(58) Field of Classification Search
CPC ..... F42C 13/04; F42C 13/045; F42C 13/047; F42B 3/10; F42B 3/12; F42B 3/121; F42D 1/045; F42D 1/055; F42D 1/05; F42D 5/00
USPC ..... 102/214, 215, 217, 218
See application file for complete search history.

(56) References Cited

U.S. PATENT DOCUMENTS

| | | | | |
|---|---|---|---|---|
| 8,448,573 | B1 * | 5/2013 | Dutton | F42C 11/002 102/206 |
| 9,115,970 | B2 * | 8/2015 | DeVries | F42C 11/008 |
| 10,466,025 | B2 * | 11/2019 | Venter | F42C 11/06 |
| 10,584,949 | B2 * | 3/2020 | Tasaki | F42D 1/045 |

* cited by examiner

Fig. 3G
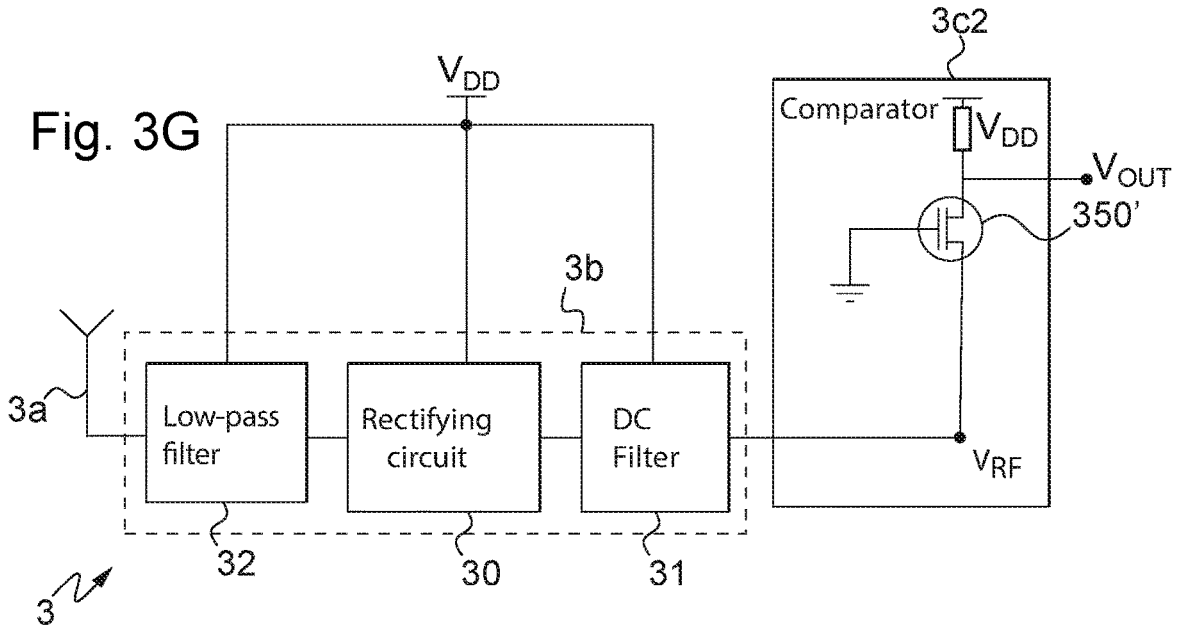
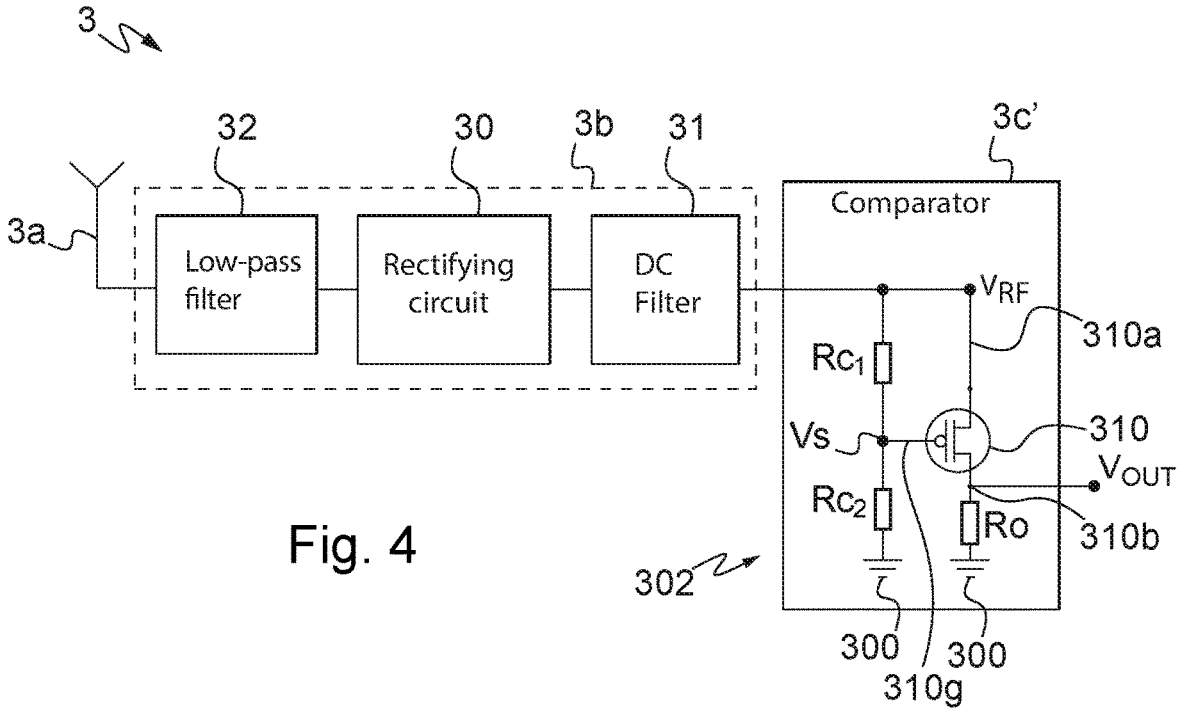
Fig. 4

WIRELESS ELECTRONIC DETONATOR

RELATED APPLICATIONS

This application is a U.S. nationalization of International Application No. PCT/FR2018/052452, filed Oct. 4, 20189 and published as PCT Publication No. WO2019/073148 on Apr. 18, 2019, which claims priority to French patent application No. FR 1759416, filed Oct. 9, 2017, the disclosure of which is hereby incorporated by reference.

TECHNICAL FIELD

The present invention concerns a wireless electronic detonator.

The invention also concerns a wireless detonation system as well as a process for activating the electronic detonator.

The invention finds its application in the field of pyrotechnic initiation, in any sector in which a network of one or more electronic detonators must conventionally be implemented. Typical examples concern the exploitation of mines, quarries, seismic exploration, and the sector of building construction and public works.

BACKGROUND

When they are used, electronic detonators are placed respectively in locations provided to receive them and are charged with explosive. These locations are for example holes bored in the ground. The firing of the electronic detonators is next carried out in a predetermined sequence.

To achieve this result, a firing delay is individually associated with each electronic detonator, and a common firing instruction is disseminated over the network of the electronic detonators using a control console. This firing instruction makes it possible to synchronize the count-down for the firing delay for all the electronic detonators. As of reception of the firing instruction, each electronic detonator manages the count-down of the specific delay associated with it, as well as its own firing.

Conventionally, the electronic detonators are linked by cables to the control console. The cabling enables the control console to supply each electronic detonator with the energy required for its operation and firing. The cabling also enables the control console to communicate with the electronic detonators, for example to exchange commands or messages with them relative to diagnostics, and to send them the firing instruction.

Wireless detonators are known which enable the cabling between the network of detonators and the control console to be dispensed with, and thus to dispense with uncertainties linked to that cabling.

A wireless detonator is disclosed by PCT Published Application No. WO2006/096920 A1. This document describes an electronic detonator comprising a fuse head, wireless communication and processing modules enabling communication with a control console, an electrical energy storage module, an energy source and a firing circuit that is connected to the energy storage module. The energy source supplies energy to the wireless communication and processing modules and to the energy storage module, these modules being functional modules of the electronic detonator or modules for implementing functions specific to the electronic detonator.

An energy source present in an electronic detonator, such as that described by PCT Published Application No. WO2006/096920 A1, could be prematurely discharged before its use, given that the firing of the detonator could take place long after its manufacture.

In order to avoid the premature discharge of an electronic detonator, it is known to add to the electronic detonator a mechanical switch that an operator activates at the time of the implementation of the network of detonators.

The reliability of such a solution is not high, malfunctions could occur for example on account of the severe environments (moisture, dust, etc.) in which the detonators are implemented. Furthermore, these mechanical switches may be manipulated by anyone, the security of a detonation system comprising such electronic detonators being limited.

SUMMARY

The present invention is directed to providing a electronic detonator enabling reliable and safe operation.

To that end, according to a first aspect, the invention is directed to a wireless electronic detonator comprising an energy source and functional modules.

According to the invention, the wireless electronic detonator comprises:

- first switching means disposed between the energy source and the functional modules, making it possible to connect or not to connect the energy source to the functional modules, and
- a control module for controlling the first switching means comprising a radio energy recovery module configured to receive a radio signal coming from a control console, recover the electrical energy in said received radio signal, generate an energy recovery signal representing the level of recovered electrical energy, and
- generate as output a control signal according to the energy recovered, said control signal controlling said switching means.

The control module thus controls the switching means such that the energy source is connected or not connected to the functional modules, that is to say such that the energy source supplies energy or does not supply energy respectively to the functional modules of the electronic detonator.

Thus, the switching means are operated in accordance with different states, an active state enabling the energy source to be connected to the functional modules and an inactive or blocked state enabling the energy source and the functional modules to be disconnected from each other.

The operation of the switching means is thus implemented by the control signal, this control signal being generated by the control module according to the electrical energy recovered by the received radio signal. The electrical energy recovered from the radio signal takes the form of an energy recovery signal having a level representing the recovered electrical energy.

Thus, it will be noted that electrically energizing the functional modules of the electronic detonator is carried out by the reception of a radio signal with sufficient energy to operate the switching means in order for the energy source to be connected to the functional modules of the electronic detonator.

So long as the control module has not operated the switching means such that they link the energy source to the functional modules, the energy source remains isolated from the functional modules of the electronic detonator.

Thus, the energy in the energy source remains preserved until the use of the electronic detonator, which will only take place after electrically energizing the functional modules, that is to say after the energy source has been connected to the functional modules via the switching means.

As the energy source has been preserved, failures on use, and in particular on firing, due to the premature discharge of the energy source are thereby avoided, and the firing of the detonator is thus more reliable.

Moreover, the manipulation of an electronic detonator with the functional modules not electrically energized before its use, as well as the electrical energizing of those functional modules carried out at the time of the putting in place of the electronic detonator before its firing, are operations that are even safer.

It will be noted that in this document, a level of energy must, to be strict, be considered as a level of power. Thus, for example, an energy recovery signal represents a level of recovered electrical power. Similarly, the presence of energy for a duration refers to the presence of power for a predetermined duration.

The following features of the wireless electronic detonator can be taken in isolation or in combination with each other.

According to a feature, the control module comprises comparing means comparing the level of the energy recovery signal representing the recovered electrical energy level, with an energy threshold value, the control signal being generated such that the first switching means connect the energy source to the functional modules when the level of the energy recovery signal passes over the energy threshold value.

The verification of energy recovered from the received radio signal of minimum value, or having a value greater than a threshold energy value, makes it possible to avoid instances of electrically energizing the functional modules of the electronic detonator by accidental activations of the switching means. The reliability of the electronic detonator and the safety during its use are thereby increased.

According to a feature, the energy threshold value is obtained from the energy source.

The energy threshold value is thus equal to a value in the range of operating potentials of the energy source, that is to say in the range of potentials having as bounds the supply potential and the earthing potential.

According to a feature, the energy threshold value is obtained from said energy recovery signal.

Thus, the presence in the control module, of a supply coming from the energy source is not necessary.

According to another feature, the energy threshold value is equal to a value outside the range of operating potentials of the energy source.

By virtue of this feature, a potential outside the range of operating potentials of the energy source must be produced by the control module, so increasing the safety of use.

As a matter of fact, a hardware failure in the control module could not produce a potential outside the operating range of the energy source. Therefore, the detection of a potential outside the range of operating potentials of the energy source signifies the reception of a radio signal of which the energy is sufficient for electrically energizing the functional modules of the electronic detonator.

The reliability of the electronic detonator and the safety during its use are improved.

According to a feature, part of the control module is referenced in relation to a reference potential equal to a value in the range of operating potentials of the energy source.

By virtue of this feature, the requisites as to the level of energy recovered are strengthened. The instances of accidental electrical energizing of the functional modules of the electronic detonator are avoided more, increasing the reliability of the electronic detonator and the safety at the time of its use.

According to a feature, the control module comprises means for verifying the time of presence of said recovery signal passing over a predetermined value, the control signal being generated such that the first switching means connect the energy source to the functional modules when the time of presence is greater than or equal to a predefined period of time.

The verifying of the time of presence of electrical energy passing over a predetermined value may be implemented by verifying the duration of the presence of the radio signal or of the energy recovery signal.

A radio signal or an energy recovery signal is considered as present when its level exceeds a predetermined value. This predetermined value may be the energy threshold value, the presence of a radio signal or of an energy recovery signal signifying that the level of energy recovered exceeds the threshold value necessary to operate the first switching means.

Thus, verifying the time of presence of electrical energy passing over a predetermined value may correspond to verifying the time during which the level of either the received radio signal or the energy recovery signal exceeds the threshold value.

The verifying of the duration of the presence of the radio signal or of the energy recovery signal in the electronic detonator makes it possible to avoid more of the accidental activations of the switching means.

According to a feature, the control module comprises at least one receiving means receiving one or more radio signals coming from a control console and at least one filtering means mounted downstream of said at least one receiving means, said at least one filtering means allowing said one or more radio signals to pass over predefined frequency bands.

By virtue of this feature, the switching means can be activated in order for the electronic detonator to be powered, only when the receiving means receive one or more radio signals of frequency belonging to a predefined frequency band.

Thus, the signals sent by devices emitting in a frequency band different from the predefined frequency band will not be taken into account by the electronic detonator, thereby limiting the risk of fraudulent use of the electronic detonator.

Therefore, the safety of use of such an electronic detonator is improved.

According to embodiments, the number of receiving means and of filtering means is identical or different. For example, in one embodiment, the control module comprises a single receiving means receiving one or more radio signals, and several filtering means mounted downstream of the receiving means, each filtering means allowing radio signals to pass in frequency bands which may be different.

According to another example, the control module comprises several receiving means and several filtering means mounted respectively downstream of the receiving means. The filtering means may allow radio signals to pass in different frequency bands.

According to a feature, the control module comprises verifying means configured to verify certain conditions relative to the frequency of the radio signals received by the filtering means.

According to a feature, the control module comprises verifying means configured to verify the presence of a signal as an output from said at least one filtering means, said control signal being generated such that said energy source is connected to the functional modules when a signal is present as an output from said at least one filtering means.

The electronic detonator can thus only be supplied when the receiving means receive a signal belonging to the predefined frequency band.

Therefore, the requirement concerning the use of a legitimate control console or device is thus strengthened.

According to a feature, the control module comprises several filtering means and verifying means that are configured to verify the order of reception of said radio signals output respectively from said several filtering means, said control signal being generated such that said energy source is connected to the functional modules when a predefined instruction is verified.

The electronic detonator can thus only be powered when the receiving means receive, in a predefined order, frequency signals belonging to the predefined frequency bands, thus increasing the safety of use of such an electronic detonator.

According to a feature, the control module comprises several filtering means and verifying means that are configured to verify the presence or the absence of a signal as an output respectively from said several filtering means and to generate as a result a combination of presences and absences, said control signal being generated such that said energy source is connected to the functional modules when a predefined combination of presences and absences is verified.

It is thus verified that the radio signals received belong to a first group of predefined frequency bands, and do not cover a second group of predefined frequency bands.

By virtue of this verifications, the requisites for use of such an electronic detonator are strengthened.

According to a feature, the control module comprises verifying means for verifying the frequency of said received radio signal, said control signal being generated such that the switching means connect said energy source to said functional modules when the received radio signal is present in a predefined frequency band.

Thus, the frequency verifying means verify that the level of the electrical energy in the radio signal exceeds a predetermined value in a predefined frequency band.

The verifying means may verify the presence of the received radio signal in a frequency band when the filtering means are not present downstream of the receiving means.

Furthermore, the verifying means may verify the presence of the received radio signal in a frequency band that is more restricted than the frequency band associated with the filtering means. In this case, the filtering means allow radio signals to pass in a wide frequency band, and the verifying means then verify the presence of a radio signal in a narrower frequency band.

The functional modules of the electronic detonator are thus only electrically energized if the radio signal is present in a predefined frequency band.

According to a feature, the functional means comprise processing means controlling said first switching means.

It will be noted that the first switching means are controlled, in addition to by the control module, by the processing means in the functional modules.

According to a feature, the processing means control the first switching means so as to keep said energy source connected beforehand to said functional modules or not to maintain said energy source connected to said functional modules.

Thus, once the functional modules, and in particular the processing means, have been electrically energized, this electrical energizing is maintained or is not maintained by control of the first switching means by the processing means. As a matter of fact, once the processing means are electrically energized, they can control the first switching means so as to maintain or cut the electrical supply of the functional modules.

It will be noted that according to the implementations of the first switching means, once the processing means are electrically energized, they are able to control the first switching means so as not to maintain the energy source connected to the functional modules or to disconnect the energy source from the switching means.

According to a feature, the processing means are configured to control the first switching means so as to maintain said energy source connected to said functional modules if the level of electrical energy recovered by said energy recovery means is greater than or equal to a predefined energy threshold value.

Thus, if the level of energy recovered is less than the predefined threshold value, the functional means which had been electrically energized are disconnected from the energy source or the connection between the functional means and the energy source is not maintained.

According to a feature, the processing means are configured to control the first switching means so as to maintain said energy source connected to said functional modules if the duration of presence of electrical energy recovered by the energy recovery module and that passes over a predetermined value exceeds a predefined period of time.

Thus, if the time of presence of the received radio signal is less than the predefined period of time, the functional means which had been electrically energized are disconnected from the energy source or the connection between the functional means and the energy source is not maintained.

According to a feature, the processing means control the first switching means so as to maintain said energy source connected to said functional modules if said received radio signal is present in a predefined frequency band.

Thus, if the frequency of the received radio signal is different from the predefined value, the functional means which had been electrically energized are disconnected from the energy source or the connection between the functional means and the energy source is not maintained.

As a variant, the processing means control the first switching means so as to maintain said energy source connected to said functional modules if received radio signals are received respectively in several frequency bands.

According to another variant, the processing means control the first switching means so as to maintain said energy source connected to said functional modules if an instruction for reception of several radio signals received respectively in several frequency bands is verified.

According to another variant, the processing means control the first switching means so as to maintain said energy source connected to said functional modules if a combination of presences and absences of several radio signals received respectively in several frequency bands is verified.

Of course, a single one or several of the above verifications concerning the frequency may be implemented. Thus, the processing means control the first switching means so as to maintain said energy source connected to said functional modules when one or more of those conditions are verified.

In one embodiment, the processing means comprise verifying means able to verify at least one condition of the aforesaid conditions to maintain or not maintain the energy source connected to the functional modules.

Thus, the verifying means of the processing means can verify whether the level of energy recovered by the energy recovery means is greater than or equal to a predefined threshold value, whether the presence of electrical energy passing over a predetermined value exceeds a predefined period of time or whether the received radio signal is present in a predefined frequency band.

Moreover, the verifying means of the processing means can verify whether radio signals are received respectively in several frequency bands, whether several radio signals are received respectively in several frequency bands in a defined reception order, or whether several radio signals are received respectively in several frequency bands according to a combination of defined presences and absences.

According to a feature, the functional means comprise wireless communication means, processing means, an energy storage module, an explosive squib, and second and third switching means, the second switching means being disposed between said first switching means and said energy storage module, and the third switching means being disposed between said energy storage module and said explosive squib, said wireless communication means being connected to the processing means, said processing means controlling said first, second and third switching means.

The second switching means make it possible to connect or not connect the first switching means to the energy storage module. Furthermore, the third switching means make it possible to connect or not connect the energy storage module to the explosive squib.

According to a second aspect, the present invention concerns a wireless detonating system comprising a wireless electronic detonator in accordance with the invention and a control console configured to emit signals to said wireless electronic detonator.

The wireless detonating system has features and advantages similar to those described above in relation to the wireless electronic detonator.

In particular, the wireless electronic detonator comprises means for electrically energizing its functional modules by virtue of the reception of a signal coming from the associated control console. Different verifications of conditions are implemented by the electronic detonator avoiding accidental or fraudulent instances of electrical energizing.

According to a third aspect, the present invention concerns a method of activating a wireless electronic detonator comprising an energy source, functional modules and first switching means which are disposed between the energy source and the functional modules and which are controlled by a control module.

According to the invention, the method comprises the following steps:

- receiving a radio signal,
- recovering electrical energy from said received radio signal,
- generating an energy recovery signal representing the level of energy recovered, and
- generating a control signal according to said recovered energy, the control signal controlling the first switching means so as to make it possible to connect the energy source to the functional modules.

Thus, the functional modules of the electronic detonator are activated or electrically energized via switching means mounted between the energy source and the functional modules which are controlled by a control signal generated when electrical energy is recovered from a radio signal by the electronic detonator.

According to a feature, the method comprises, prior to generating said control signal, verifying a condition relative to the received radio signal or the energy recovery signal.

In other words, the method comprises verifying a condition relative to the level of electrical energy recovered from said radio signal.

Thus, verifications can be implemented before operating the activation of the functional modules of the electronic detonator.

According to a feature, the method further comprises, after generating said control signal, performing verification of a condition relative to the radio signal or relative to the energy recovery signal, and a step of maintaining said first switching means operated so as to maintain the energy source connected to the functional modules according to the result of said verification.

The functional modules that have been activated by the operation of the switching means are maintained activated. Thus, once the conditions have been verified, the electrical supply of the first switching means is maintained.

According to a feature, the verification comprises comparing the level of an energy recovery signal representing the level of recovered electrical energy with an energy threshold value, the first switching means being operated so as to maintain the energy source connected to the functional modules when said level of the energy recovery signal is greater than or equal to the energy threshold value.

According to a feature, the verification comprises determining the time of presence of electrical energy recovered from the received radio signal exceeding a predetermined value, the first switching means being operated so as to maintain the energy source connected to the functional modules when said determined time of presence is greater than or equal to a predefined period of time.

According to a feature, the verification comprises verifying the presence of said radio signal received by the receiving means in a predefined frequency band, the first switching means being operated so as to maintain the energy source connected to said functional modules when the radio signal is received in the predefined frequency band.

According to another feature, the verification comprises verifying the presence of radio signals in several predefined frequency bands, the processing means being controlled so as to maintain the energy source connected to said functional modules when the radio signals are received respectively in several predefined frequency bands.

According to another feature, the verification comprises verifying the reception order of several radio signals received respectively in several frequency bands, the processing means being controlled so as to maintain the energy source connected to said functional modules when a predefined instruction is verified.

According to another feature, the verification comprises verifying the presence or the absence of several radio signals received respectively in several frequency bands, the processing means being controlled so as to maintain the energy source connected to said functional modules when a combination of presences and absences of several radio signals received respectively in several frequency bands is verified.

The activation method has features and advantages similar to those described above in relation to the wireless electronic detonator and the wireless detonating system.

Other particularities and advantages of the invention will furthermore appear in the following description.

BRIEF DESCRIPTION OF THE DRAWING

In the accompanying drawings, given by way of non-limiting example:

FIGS. 2A, 2B, 3A to 3G and 4 are block diagrams illustrating different example embodiments of a control module implemented in a wireless electronic detonator in accordance with the invention;

DETAILED DESCRIPTION

Figure 1A:
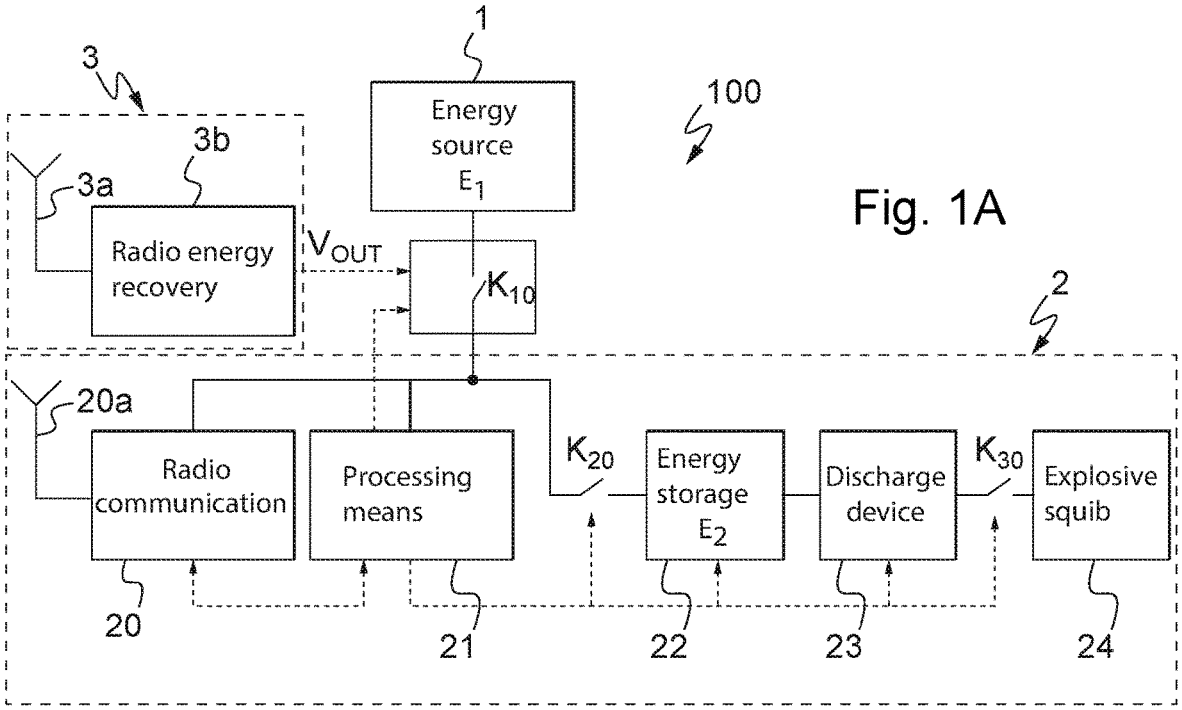
FIGS. 1A and 1B are block diagrams illustrating a wireless electronic detonator according to embodiments of the invention.

FIG. 1A represents a wireless electronic detonator according to a first embodiment.

The electronic detonator 100 comprises an energy source 1 and functional modules 2 implementing different functions of the electronic detonator 100. The functional modules 2 will be detailed below.

The energy source 1 enables the electrical supply of the functional modules 2 via first switching means or activating/deactivating mechanism for the electrical supply K10.

The first switching means K10 are disposed between the energy source 1 and the functional modules 2 so as to connect the energy source 1 to the functional modules 2 when the switching means K10 are activated, and to maintain the functional modules 2 disconnected from the energy source 1 when the switching means K10 are not activated.

Thus, in other words, the switching means K10 make it possible to control the electrical energizing or electrical supply of the functional modules 2 of the electronic detonator 100 from the energy source 1.

The activation or deactivation of the switching means K10 is controlled, as will be described in detail later, by a control module 3 in a first phase, and by processing means 21 belonging to the functional modules 2 in a second phase.

The control module 3 comprises a radio energy recovery module 3*b* (illustrated in FIGS. 2A, 2B, 3A to 3E and described below) which is configured to recover the electrical energy in the radio signal received by the receiving means 3*a*. The received radio signal is also named tele-electrical supply signal.

The receiving means 3*a* are configured to receive a radio signal coming from a control console (not visible in the Fig.).

This control console emits, among others, radio signals enabling the electrical energizing of the functional modules 2, or tele-electrical supply signals.

The receiving means 3*a* comprise an antenna 3*a*. By way of example that is in no way limiting, the receiving means are configured to receive signals in the frequency bands from 863 to 870 MHz, from 902 to 928 MHz and from 433 to 435 MHz. Of course, other frequency bands may be used.

The control module 3 generates as output a control signal $V_{OUT}$ which is a function of the electrical energy recovered by the energy recovery module 3*b*. The control signal $V_{OUT}$ controls the first switching means K10 so as to activate them, thus connecting the functional modules 2 to the energy source 1, or so as not to activate them, maintaining the functional modules 2 disconnected from the energy source 1.

In the described embodiment, the functional modules 2 comprise radio communication means 20, processing means 21, an energy storage module 22, a discharge device 23 and an explosive squib 24.

The functional modules 2 further comprise second switching means K20 and third switching means K30.

The energy storage module 22 is dedicated to storing the energy necessary for the firing of the explosive squib 24.

In one embodiment, the energy storage module 22 comprises one or more capacitors, and one or more voltage step-up stages.

In one embodiment, the energy storage module 22 is charged to a voltage less than the voltage required for the firing of the explosive squib 24 and is configured to give out the energy at a higher voltage enabling the firing of the explosive squib 24.

The second switching means K20 are disposed between the first switching means K10 and the energy storage module 22.

The second switching means K20 constitute an isolating mechanism making it possible to isolate the energy storage means 22 that are dedicated to the firing.

The isolating mechanism K20 makes it possible to activate or not to activate the energy transfer from the energy source 1 to the energy storage module 22.

In the described embodiment, the second switching means or isolation mechanism K20 comprise a switch.

The isolation mechanism or second switching means K20 are controlled by the processing means.

The third switching means K30, or firing mechanism, make it possible to activate or deactivate the transfer of the energy stored in the energy storage module 22 to the explosive squib 24 at the time of the firing of the electronic detonator 100.

Thus, the second and/or third switching means K20, K30, according to the commands received by the wireless switching means 20, can for example be activated in order for the energy coming from the energy source 1 to be transferred to the energy storage module 22, and/or for the energy of the energy storage module 22 to be transferred to the explosive squib 24.

The wireless switching means 20, being preferably bidirectional, make it possible to receive messages and commands as well as to emit messages.

The wireless communication means 20 comprise an antenna 20*a* receiving or emitting messages. The messages received by the wireless communication means 20 are processed by the processing means 21.

The wireless communication means 20 enable the communication of the electronic detonator 100 with for example a control console located remotely.

Thus, the wireless electronic detonator 100 and a communication console are able to exchange messages, for example for programming the firing delay of the electronic detonators, for the diagnostic of the electronic detonator or for the firing.

The processing means 21 are configured to manage the operation of the electronic detonator 100, in particular the processing means 21 make it possible to:

analyze the messages received via the wireless communication means 20, act according to the meaning of the messages received and for example execute one of the following actions, to perform a diagnostic of the various functionalities of the electronic detonator 100, to initiate the sending of a radio message via the wireless communication means 20, for example destined for the remote control console, to activate the storage of energy in the energy storage module 22 for the firing, to perform the count-down of the firing delay associated with the electronic detonator 100, to activate the energy transfer from the energy storage module 22 to the explosive squib 24 at the end of the count-down, via the firing mechanism K30, to activate the discharge device 23, to control a mechanism for maintaining the activation of the first switching means K10, to control a mechanism for deactivating the electrical energizing of the functional modules 2 acting on the first switching means K10, to control a mechanism K20 for energy transfer from the energy source 1 to the energy storage unit 22.

These functionalities of the processing means 21 will be described in more detail below, in particular those relating to the electrical energizing and electrical de-energizing of the functional modules 2 of the electronic detonator 100.

In the described embodiment, the electronic detonator 100 comprises a discharge device 23 enabling a slow discharge of the energy storage module 22 so as to discharge the energy stored in that module 22 and to return to a safe state in case of electrical de-energizing of the electronic detonator 100.

As a variant, the discharge device may comprise a fast discharge mechanism mounted in parallel to the device enabling fast discharge in order to quickly return to a safe state on reception of a command coming from the processing means 21.

Figure 1B:
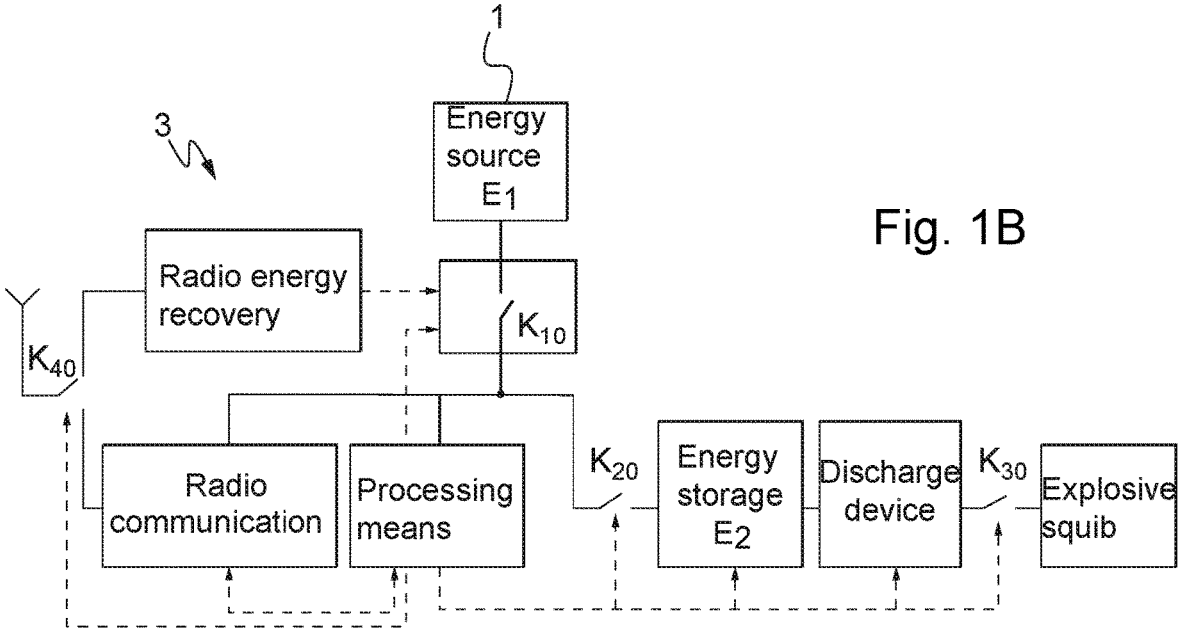

A second embodiment of an electronic detonator is represented in FIG. 1B.

In this variant embodiment, the radio technologies used for the recovery of radio energy or tele-electrical supply and for the communication between the remote control console and the electronic detonator 100 are identical. Thus, at short distance, the power of the radio signal enables sufficient energy to be provided to tele-supply the first switching means or activating/deactivating mechanisms K10 of the wireless electronic detonator 100, and at long distance, the wireless communication means comprise a conventional radio modulator/demodulator which is used for the exchange of the messages between the control console and the electronic detonator 100.

In this embodiment, the wireless electronic detonator 100 comprises a radio switching module K40 making it possible to link the receiving means or antenna 3*a* of the control module 3 to the radio energy recovery module 3*b* or to the wireless communication means 20 in the functional module 2. Thus, the radio switching module K40 makes it possible to pass from one mode to another in order to avoid power losses in the modules not used.

In one embodiment, the radio switching module K40 is positioned by default such that the antenna 3*a* is linked to the energy recovery module 3*b*. When the functional modules 2 are electrically energized, the processing means 21 control the positioning of the radio switching module K40 such that the antenna is linked to the wireless communication means 20 of the functional modules 2 in order to perform the exchanges of the radio messages with the remote control console.

It will be noted that the switching of the radio switching module K40 is implemented after the processing means 21 has operated the maintenance of energy via the first switching means K10.

In this embodiment, the hardware resources, both at the electronic detonator 100 end and at the control console end, are shared. As a matter of fact, a single antenna may be used, this antenna 3 being placed in common for the activating/deactivating mechanism for the electrical supply of the electronic detonator 100 and for the communication of the electronic detonator 100 with the control console.

It will be noted that that in this embodiment, it may be advantageous to use a pairing technology based on control of the emission power. Thus, a single technology is used for all the operations of activation, communication, and pairing, the costs of the wireless electronic detonator thus being limited.

The pairing operations are used to verify that the control console exchanges messages with a selected electronic detonator 100 and not with another. These operations are described later.

Figure 2A:
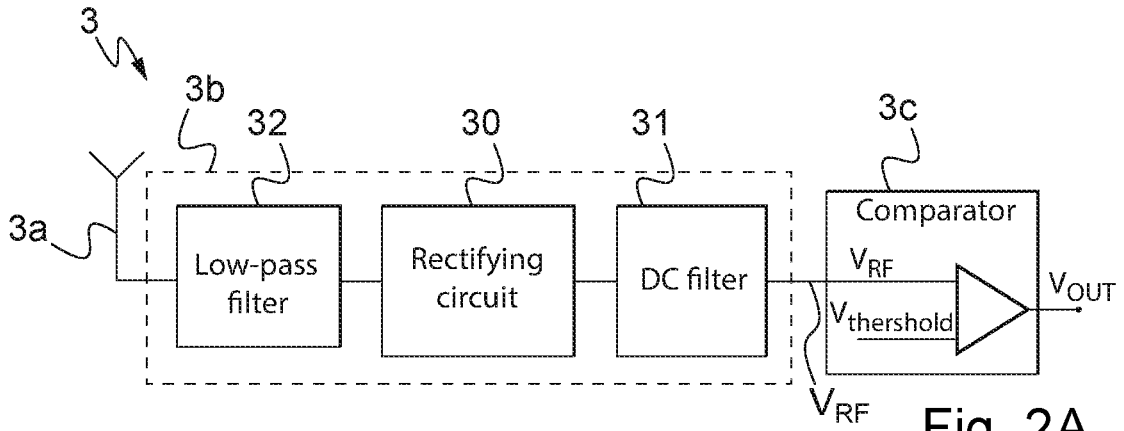

FIG. 2A represents a control module 3 of the switching means K10 according to one embodiment The control module 3 comprises a module 3*b* for recovery of radio energy from the radio signal received by the receiving means 3*a*.

Generally, a radio energy recovery module comprises an antenna 3*a* and a rectifying circuit 30 followed by a DC filter 31 enabling the recovery of the energy of the signal rectified by the rectifying circuit 30.

The assembly formed by the antenna 3*a*, the rectifying circuit 30 and the DC filter 31 is known and commonly designated by the term "Rectenna" (derived from "Rectifying Antenna").

In known manner, a low pass filter 32 may be added between the antenna 3*a* or the receiving means, and the rectifying circuit 30 for reasons of adapting impedance and of suppressing the harmonics generated by the rectifying circuit 30.

At the output from the DC filter 31 or output from the energy recovery module 3*b*, an energy recovery signal $V_{RF}$ is generated which represents the level of electrical energy recovered from the received radio signal.

In the described embodiment, the control module 3 further comprises comparing means 3*c* configured to compare the level of the energy recovery signal $V_{RF}$ with an energy threshold value $V_{threshold}$.

The comparing means 3*c* generate as output the control signal $V_{OUT}$ controlling the first switching means or activating/deactivating mechanism K10. The control signal $V_{OUT}$ may be generated in a first state or a second state according to the result of the comparison implemented by the comparing means 3*c*.

Thus, the state of the control signal $V_{OUT}$ is a function of the level of the energy recovery signal $V_{RF}$ relative to an energy threshold value $V_{threshold}$.

Therefore, when the level of the recovered energy or level of the energy recovery signal $V_{RF}$ passes over the energy threshold value, the control signal $V_{OUT}$ is generated in a first state such that the switching means K10 are in the active state, that is to say that they connect the energy source 1 to the functional modules 2.

On the contrary, when the level of the recovered energy or level of the energy recovery signal $V_{RF}$ does not pass over the energy threshold value, the control signal $V_{OUT}$ is generated in a second state such that the switching means K10 are in the inactive state, that is to say that they do not connect the energy source 1 to the functional modules 2.

It will be noted that in some embodiments, the control signal $V_{OUT}$ is generated in a first state when the level of the energy recovery signal $V_{RF}$ is greater than the energy threshold value and in a second state when the level of the energy recovery signal $V_{RF}$ is less than the energy threshold value.

In some embodiments, the control signal $V_{OUT}$ is generated in a first state when the level of the energy recovery signal $V_{RF}$ is less than the energy threshold value and in a second state when the level of the energy recovery signal $V_{RF}$ is greater than the energy threshold value.

Of course, the expressions "greater than" and "less than" may be replaced by "greater than or equal to" and "less than or equal to" respectively.

The comparing means 3*c* make it possible to avoid accidental electrical energizing of the functional modules 2, thereby increasing the safety of use of such an electronic detonator 100.

Figure 2B:
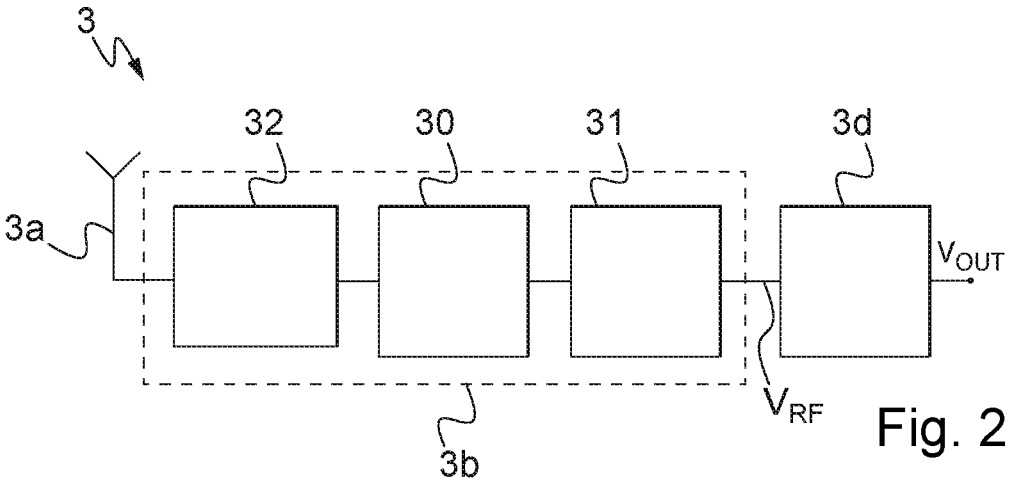

FIG. 2B represents a control module 3 according to another embodiment. The control module 3 comprises a processing unit 3*d* receiving as input the energy recovery signal $V_{RF}$ and generating as output the control signal $V_{OUT}$.

According to one embodiment, the processing unit 3*d* comprises comparing means. Thus, the processing unit compares the level of the energy recovery signal $V_{RF}$ with the predefined energy threshold value, generating as output the control signal $V_{OUT}$ as a function of the result of that comparison.

It will be noted that the processing unit 3*d* of FIG. 2B is able to replace the comparing means 3*c* of FIG. 2A or be mounted in the control module 3 in addition to the comparing means 3*c*.

In another embodiment, the control module 3 does not comprise comparing means such as those represented in FIG. 2A or in the processing unit of FIG. 2B. Thus, the switching means K10 are activated as soon as the energy recovery signal $V_{RF}$ has a sufficient level of electrical energy to activate switching means K10. A comparison of the level of recovered electrical energy with the energy threshold value may be implemented by the processing means 21 in the functional modules 2, once they have been electrically energized by virtue of the activation of the switching means K10.

As will be described below, according to the result of this comparison, the electrical energizing of the functional modules 2 is maintained if the level of the recovered electrical energy is greater than or equal to the energy threshold value or is not maintained in the opposite case.

In another embodiment, the control module 3 may comprise means for verifying the time of presence of the received radio signal. These verifying means may form part of the processing unit 3*d* of FIG. 2B.

The verifying means verify whether the time of presence of the received radio signal is greater than or equal to a predefined period of time, in which case the control signal $V_{OUT}$ is generated such that the switching means K10 are activated, that is to say such that they connect the energy source to the functional modules 2.

A radio signal or an energy recovery signal is considered as present when its level exceeds a predetermined value. This predetermined value may be the energy threshold value, the presence of a radio signal or of an energy recovery signal signifying that the level of recovered energy exceeds the threshold value necessary to operate the first switching means K10.

Thus, verifying the time of presence of electrical energy passing over a predetermined value may correspond to verifying the time during which the level of either the received radio signal or the energy recovery signal exceeds the threshold energy value.

Means for verifying the time of presence of a signal are known to the person skilled in the art.

By way of example, the means for verifying the time of presence of a signal may comprise a delay circuit, for example of RC type. This delay circuit delays the control signal $V_{OUT}$ generating a delayed control signal. If the control signal $V_{OUT}$ and the delayed control signal $V_{OUT}$ are active at the same time, the condition of duration of radio presence is validated.

The presence of the means for verifying the time of presence of the received radio signal in the control module is independent of the presence of the comparing means. Thus, the control module may comprise the comparing means and/or the means for verifying the time of presence.

Furthermore, the comparing means and/or the means for verifying the time of presence may form part of or be independent from the processing unit 3*d*.

Various embodiments for the control module 3 furthermore comprising comparing means 3*c* are represented in FIGS. 3A to 3G and 4.

According to embodiments, the detection of sufficient energy coming from the radio signal is carried out differently. FIGS. 3A to 3G and 4 represent control modules 3 for controlling the switching means K10 according to different embodiments.

In the described embodiments, the level of the energy recovery signal $V_{RF}$ is a level of electric potential.

By virtue of the presence of the comparing module 3*c*, it is possible to establish a level of potential (or threshold value $V_{threshold}$) through comparison of which the control signal $V_{OUT}$ is generated so as to activate the switching means K10.

The comparing module 3*c* thus receives the energy recovery signal $V_{RF}$ and is configured to detect when the energy recovery signal $V_{RF}$ passes over a threshold value.

In a first group of embodiments represented in FIGS. 3A to 3G, the energy threshold value $V_{threshold}$ is generated adjustably based on the value of the supply voltage $V_{DD}$ and the zero or earthing reference potential 300.

In the embodiment represented in FIG. 4, the energy threshold value $V_{threshold}$ is generated from the energy recovery signal $V_{RF}$.

Figure 3A:
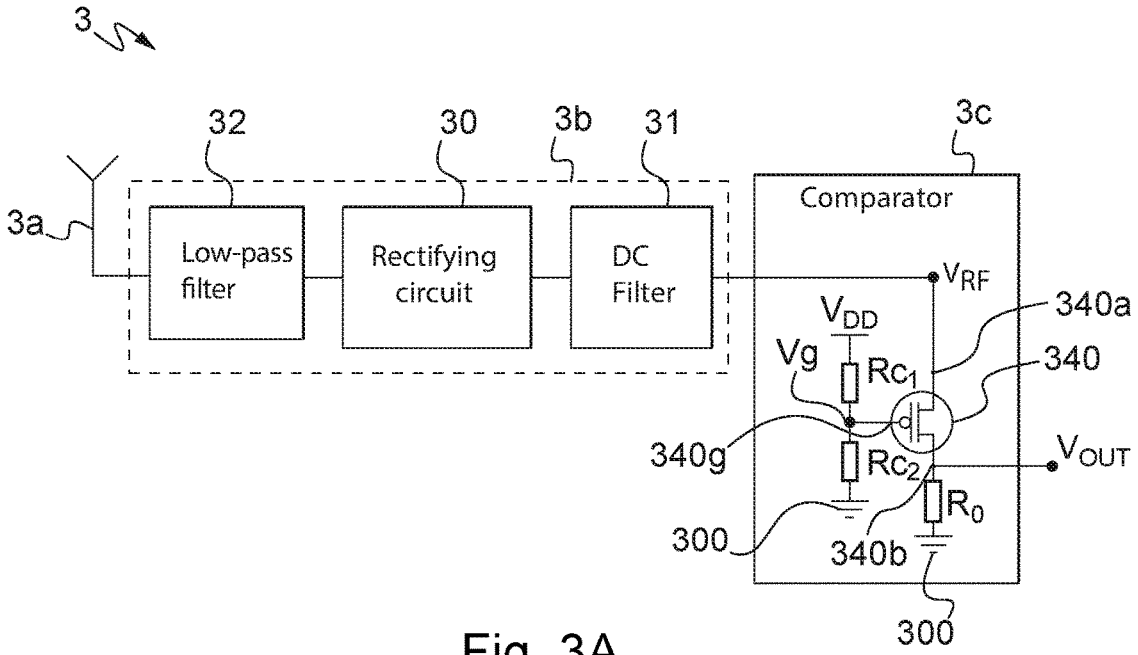

A first embodiment is represented in FIG. 3A. In this embodiment, the energy threshold value $V_{threshold}$ is generated adjustably on the basis of the value of the supply voltage $V_{DD}$ and the zero or earthing potential 300.

In this embodiment, the comparing module 3*c* comprises a transistor, which is a PMOS transistor 340 in the embodiment represented, connected by a first terminal 340*a*, corresponding to its source, to the output of the DC filter 31, the control signal $V_{OUT}$ being taken at a second terminal 340*b* of the PMOS transistor 340 corresponding to its drain. The second terminal 340*b* is connected to the earth 300 via a pull-down resistor R0.

In this embodiment, the voltage Vg applied to the gate 340*g* of the transistor 340 can be adjusted between the value of the supply voltage $V_{DD}$ and the zero or earth reference potential 300.

Thus, the threshold value, beyond which the control signal $V_{OUT}$ is generated so as to activate the switching means K10, is thus equal to the voltage Vg applied to the gate 340*g* of the transistor 340 plus the threshold voltage $V_{th}$ or voltage for making the transistor 340 conduct.

Therefore, in this embodiment, the value of the threshold $V_{threshold}$ can vary between the threshold voltage $V_{th}$ of the transistor 340 and the supply voltage $V_{DD}$ plus the threshold voltage $V_{th}$ of the transistor 340.

The comparing module comprises two resistors Rc1, Rc2 forming a voltage divider bridge 302. A first resistor Rc1 is connected between the supply voltage $V_{DD}$ and the gate 340*g* of the transistor 340 and a second resistor Rc2 is connected between the gate 340*g* of the transistor 340 and the earth 300. According to the values of the first resistor Rc1 and the second resistor Rc2, the value applied to the gate 340*g* of the transistor 340 is fixed and therefore the energy threshold value $V_{threshold}$ is fixed.

Figure 3B:
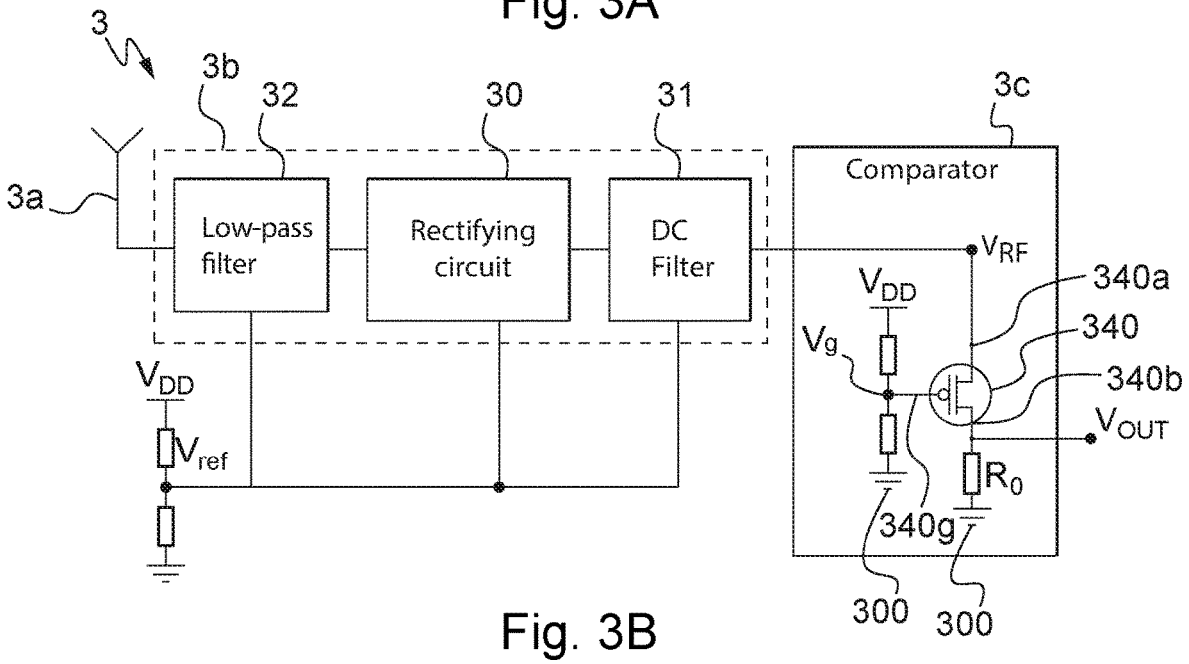

Another embodiment of the control module 3 is represented in FIG. 3B. This embodiment corresponds to the embodiment of FIG. 3A in which the reference potential $V_{ref}$ used by the energy recovery module 3*b* is generated adjustably on the basis of the value of the supply voltage $V_{DD}$ and the zero or earth reference potential 300.

The use of a reference potential that is adjustable for the energy recovery module 3*b*, combined with the use of an adjustable threshold value $V_{threshold}$ for the comparing module 3*c* makes it possible to adjust the level of energy to recover from the radio signal to activate the first switching means K10.

Figure 3C:
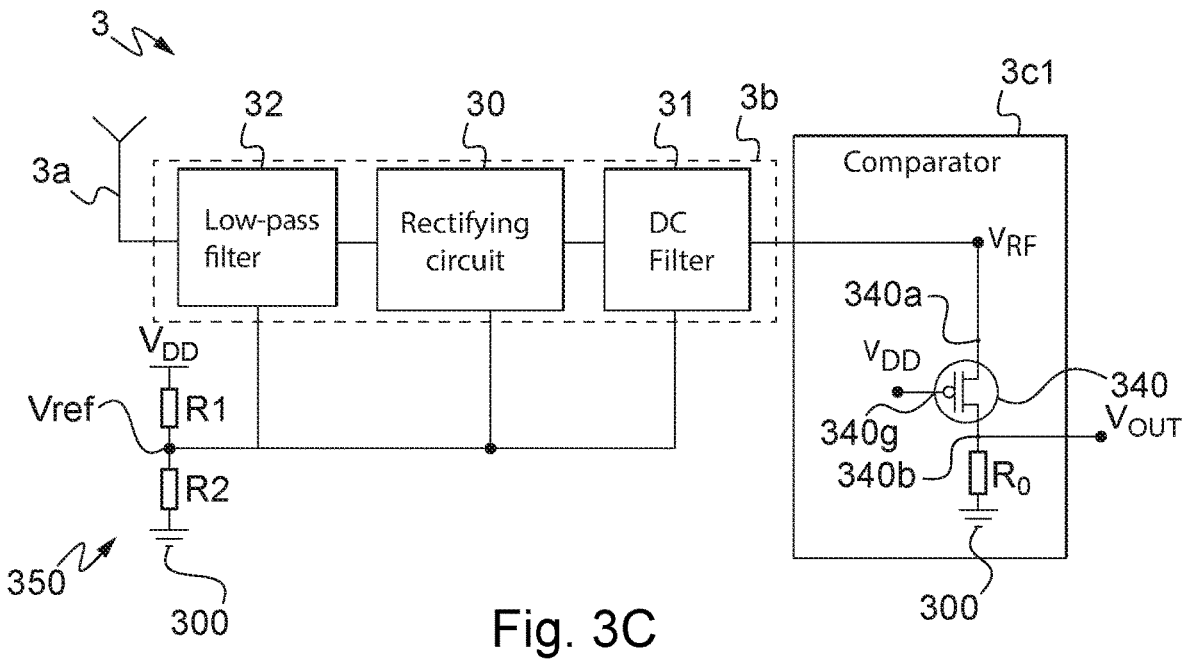

In the embodiment shown in FIG. 3C, the comparison module 3*c*1 comprises a transistor, which is a PMOS transistor 340 in the embodiment represented, connected by a first terminal 340*a*, corresponding to its source, to the output of the DC filter 31, the control signal $V_{OUT}$ being taken at a second terminal 340*b* of the PMOS transistor 340 corresponding to its drain. The second terminal 340*b* is connected to the earth 300 via a pull-down resistor R0.

The gate 340*g* of the transistor 340 is fixed to the supply voltage $V_{DD}$, generated from the energy source 1. The threshold value used, beyond which the control signal $V_{OUT}$ is generated so as to activate the switching means K10, is thus equal to the supply voltage $V_{DD}$ plus the threshold voltage $V_{th}$ or voltage for making the transistor conduct.

In this embodiment, the various modules of the rectenna or energy recovery module 3*b* are referenced relative to a reference potential $V_{ref}$.

The reference potential $V_{ref}$ is obtained from the supply voltage $V_{DD}$ that comes from the energy source 1.

According to one embodiment, the reference potential $V_{ref}$ is obtained by means of a voltage divider bridge 350 mounted between the supply voltage $V_{DD}$ and earth. The value of the reference potential $V_{ref}$ thus has a value comprised between earth and the supply voltage $V_{DD}$ and is fixed by the value of the resistors R1, R2 forming the voltage divider bridge 350.

When the control module 3 does not receive any signal, that is to say when the electronic detonator 100 is at rest, the potential or level of the energy recovery signal $V_{RF}$ is equal to the reference potential $V_{ref}$. The PMOS transistor 340 behaves as an open switch and the control signal generated is a potential $V_{OUT}$ of 0 Volt.

When the control module 3 receives a signal whose electrical energy is such that the potential difference $V_{RF}-V_{ref}$, corresponding to the difference between the level of the energy recovery signal $V_{RF}$ and the reference potential $V_{ref}$, has a value greater than the supply voltage $V_{DD}$ minus the reference potential $V_{ref}$ plus the threshold voltage $V_{th}$ of the transistor 340, the transistor 340 becomes conducting and the control signal $V_{OUT}$ becomes equal to the potential $V_{RF}$.

The passing of the control signal $V_{OUT}$ from the rest value 0 to the potential value $V_{RF}$ makes it possible to operate the switching means K10 into an active state, the functional modules 2 thus being electrically energized.

It will be noted that the recovery of electrical energy, represented by the potential difference $V_{RF}-V_{ref}$, of greater value than the supply voltage $V_{DD}$ minus the reference potential $V_{ref}$ plus the threshold value $V_{th}$ of the transistor enables the activation of the switching means K10 and thus the electrical energizing of the functional modules 2 of the electronic detonator 100.

Therefore, the switching means K10 are only activated when the level of the electrical energy recovery signal $V_{RF}$ has a value outside the range of operating potentials of the energy source 1. In particular, in the case described, the level of the electrical energy recovery signal $V_{RF}$ or activation potential must exceed the supply potential $V_{DD}$ plus the threshold voltage $V_{th}$ of the transistor 340.

It will be noted that this activation potential $V_{RF}$ cannot be generated by the energy source 1, the maximum level of the potential that can be supplied by the energy source 1 being the supply potential $V_{DD}$. Thus, the safety of such an electronic detonator is improved.

Figure 3D:
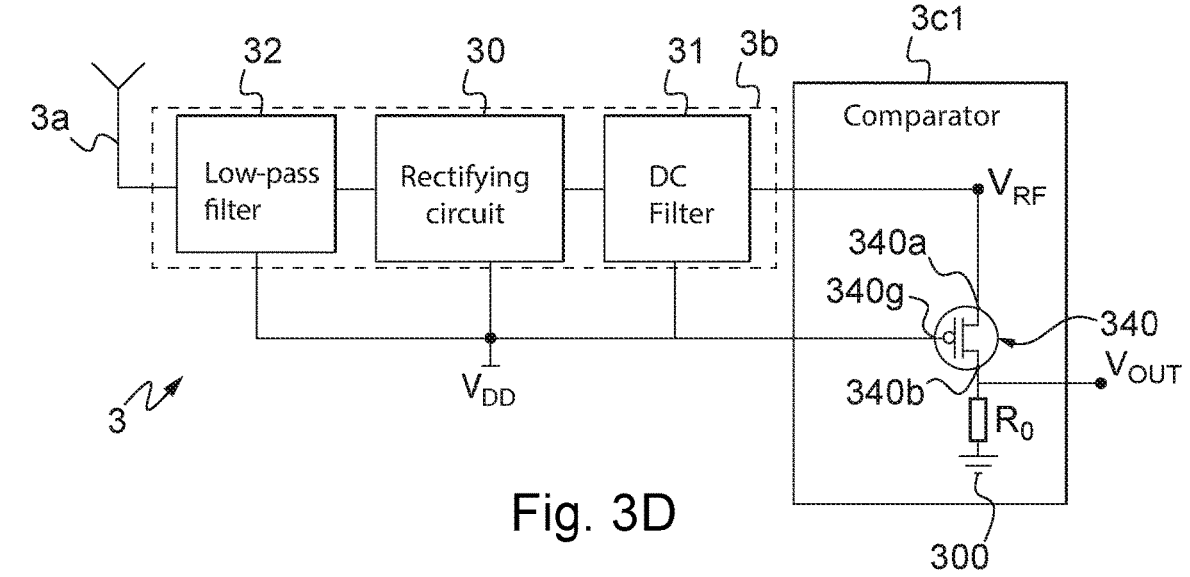

FIG. 3D represents a control module 3 comprising a comparing module 3*c*1.

In this embodiment, the modules constituting the energy recovery module 3*b*, which here are the low-pass filter 32, the rectifying circuit 30 and the DC filter 31 are referenced to the supply potential $V_{DD}$.

The comparing module is similar to that represented in FIG. 3C and will not be described here. The threshold value used, beyond which the control signal $V_{OUT}$ is generated so as to activate the switching means K10, is thus equal to the supply voltage $V_{DD}$ plus the threshold voltage $V_{th}$ or voltage for making the transistor conduct.

Thus, when the electronic detonator 100 is at rest, that is to say that no radio signal is received by the receiving means 3*a*, the activation potential $V_{RF}$ representing the level of electrical energy recovered is equal to the supply voltage 100 As the gate 340*g* of the transistor 340 is connected to the supply voltage $V_{DD}$ and as its source potential 340*a* is also at $V_{DD}$, the transistor 340 behaves as an open switch, and the potential represented by the control signal $V_{OUT}$ is equal to 0 (the pull-down resistor R0 connecting the terminal 340*b* of the transistor 340 to earth 300).

When the control module 3 receives a radio signal, the activation potential $V_{RF}$ becomes greater than the supply voltage $V_{DD}$, the transistor 340 becoming conducting when the potential difference ($V_{RF}-V_{DD}$) exceeds the threshold voltage $V_{th}$ of the PMOS transistor 340.

Thus, the potential represented by the control signal $V_{OUT}$ becomes equal to the potential represented by the recovery signal $V_{RF}$. The change in potential on the control signal $V_{OUT}$ drives the switching means K10 into an active state, the functional modules 2 of the electronic detonator 100 then being energized.

It will thus be noted that when a potential greater than the supply voltage $V_{DD}$ (which supply voltage $V_{DD}$ is supplied by the energy source 1) plus the threshold voltage $V_{th}$ of the transistor 340 is detected at the output of the energy recovery module 3*b*, the functional modules 2 of the electronic detonator 100 are electrically energized.

Figure 3E:
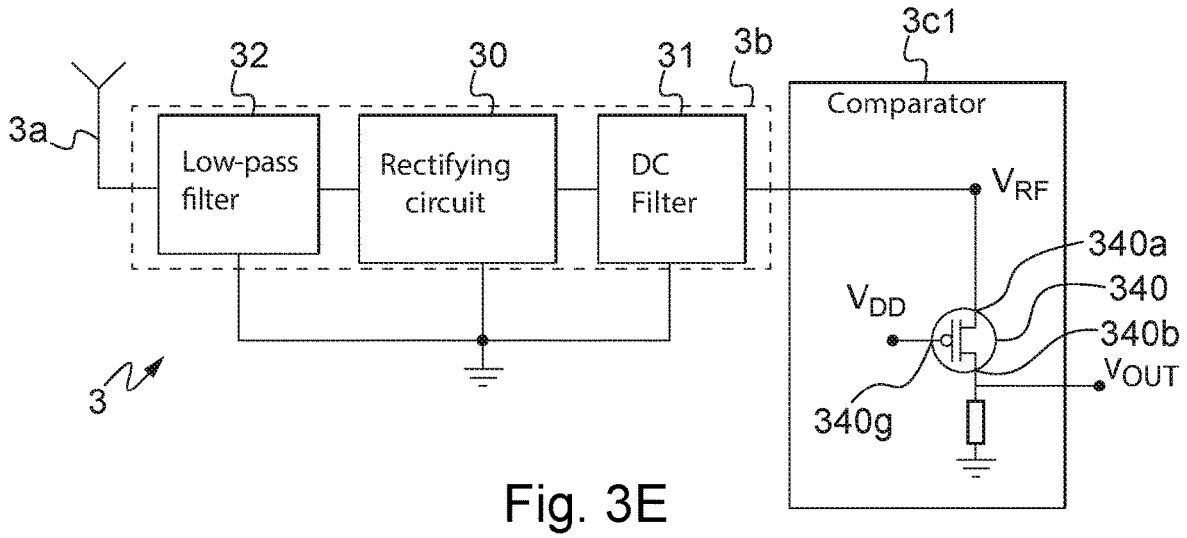

FIG. 3E represents another embodiment of a control module 3 comprising a comparing module 3*c*1.

In this embodiment, the modules forming the rectenna or energy recovery module 3*b* are referenced to the earth 300.

The comparing module 3*c*1 is similar to that represented in FIG. 3C and will not be described here. The threshold value used, beyond which the control signal $V_{OUT}$ is generated so as to activate the switching means K10, is thus equal to the supply voltage $V_{DD}$ plus the threshold voltage $V_{th}$ or voltage for making the transistor conduct.

In this embodiment, when the control module 3 is at rest, the potential represented by the recovery signal $V_{RF}$ is equal to 0.

When the control module 3 receives a radio signal, the activation potential $V_{RF}$ becomes positive, the transistor 340 becoming conducting when the activation potential $V_{RF}$ output from the energy recovery module 3*b* exceeds the supply voltage $V_{DD}$ plus the threshold voltage $V_{th}$ of the PMOS transistor 340. In this embodiment, the recovered energy must thus have a high value, the safety of an electronic detonator 100 comprising a control module 3 according to this embodiment being improved.

Figure 3F:
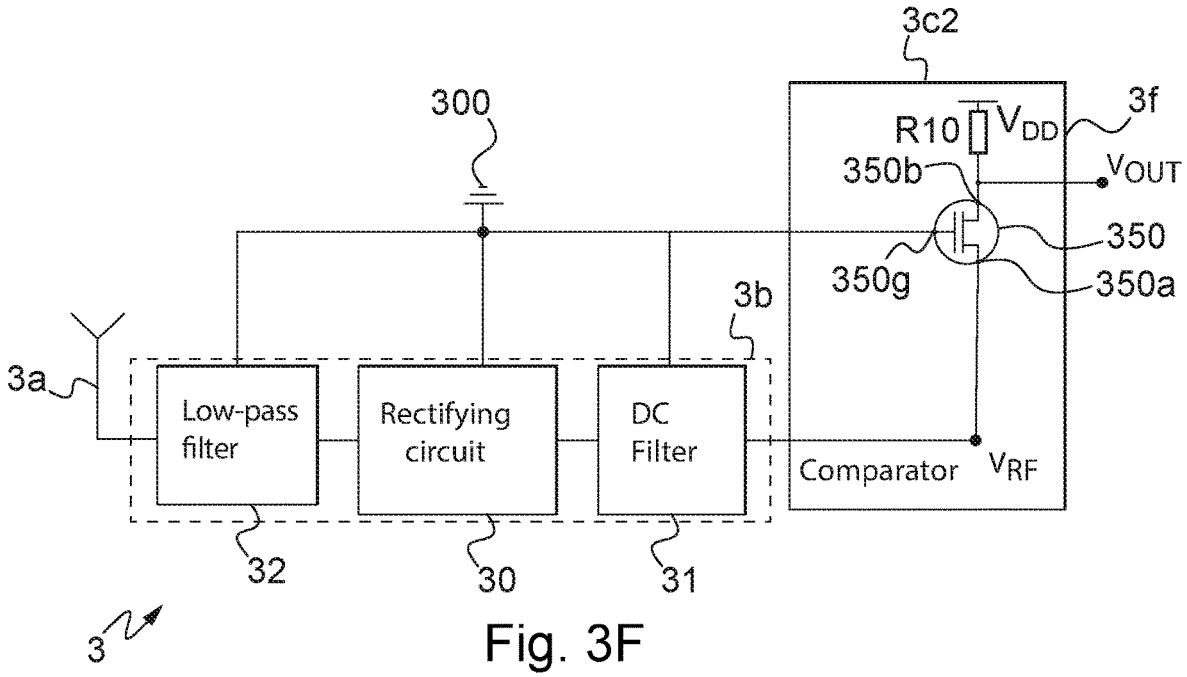

Another embodiment of a control module 3 is represented in FIG. 3F. The arrangement represented by this Fig. generates a negative potential difference as output from the energy recovery module 3*b*.

The modules (31, 32, 33) forming the rectenna or energy recovery module 3*b* have a reversed polarity relative to the module described above. The technology for forming a rectenna having negative polarity is known to the person skilled in the art and is not described in detail here.

The comparing module 3*c*2 comprises an NMOS type transistor 350 of which the source is connected by a first terminal 350*a* to the output of the energy recovery module 3*b*, the control signal $V_{OUT}$ output from the control module 3 being taken at a second terminal 350*b* at the drain of the NMOS transistor 350. The second terminal 350*b* of the NMOS transistor is connected to a pull-up resistor R10 which is in turn connected to the supply voltage $V_{DD}$.

The gate 350*g* of the NMOS transistor 350 is connected, in this embodiment, to earth 300. The threshold value used, short of which the control signal $V_{OUT}$ is generated so as to activate the switching means K10, is thus equal to the opposite of the threshold voltage $V_{th}$ or voltage for making the transistor conduct..

In this embodiment, the modules forming the rectenna or energy recovery module 3*c* are referenced to the earth 300.

In a variant of this embodiment, the potential applied to the gate 350*g* of the transistor 350 may be variable between the earth 300 and the supply potential $V_{DD}$. This potential may be obtained in similar manner to FIGS. 3A and 3B, that is to say by using a voltage divider.

In still another variant, the modules forming the rectenna or energy recovery module 3*b* are referenced at a reference potential $V_{ref}$ which is variable between earth 300 and the supply potential $V_{DD}$. This potential may be obtained in similar manner to FIG. 3B, that is to say by using a voltage divider.

When the control module 3 receives no tele-supply signal, that is to say that the electronic detonator 100 is at rest, the potential difference between the potential represented by the recovery signal $V_{RF}$ and earth 300 is zero, that is to say that the potential represented by the energy recovery signal $V_{RF}$ has a value of 0 Volt. The NMOS transistor 350 thus behaves as an open switch, and the potential represented by the control signal $V_{OUT}$ is equal to the supply voltage $V_{DD}$.

When the control module 3 receives a tele-supply signal, the potential difference between the potential of the recovery signal $V_{RF}$ and the earth 300 is negative, the transistor 341 becoming conducting when that voltage is sufficiently negative, that is to say that the potential difference exceeds, in absolute value, the threshold voltage $V_{th}$ of the transistor.

Thus, the potential represented by the control signal $V_{OUT}$ drops and is equal to the potential represented by the recovery signal $V_{RF}$, which has a value less than 0 Volt.

Therefore, the switching means K10 are only activated when the level of the electrical energy recovery signal $V_{RF}$ presents a value outside the range of operating potentials of the energy source 1. In particular, in the case described, the level of the electrical energy recovery signal $V_{RF}$ or activation potential must be less than the opposite of the threshold voltage $V_{th}$ of the transistor 350.

It will be noted that this activation potential $V_{RF}$ cannot be generated by the energy source 1, the level of the minimum potential being equal to the earth. Thus, the safety of such an electronic detonator is improved.

In a manner equivalent to the embodiment represented in FIG. 3E, FIG. 3G represents an embodiment in which the activation of the switching means K10 requires a potential difference of value greater than the embodiment described above with reference to FIG. 3F.

The comparing module 3*c*2 is similar to that represented in FIG. 3F and will not be described here. The threshold value $V_{threshold}$ used, short of which the control signal $V_{OUT}$ is generated so as to activate the switching means K10, is thus equal to the opposite of the threshold voltage $V_{th}$ or voltage for making the transistor conduct 350.

In this embodiment, the modules forming the rectenna or energy recovery module 3*b* are referenced relative to the supply voltage $V_{DD}$ instead of being referenced relative to the earth.

The operation is similar to that described with reference to FIG. 3D, except that in order for the transistor 350 of the comparing module 3*c*2 to become conducting, the potential difference ($V_{RF}$-$V_{DD}$) output from the energy recovery module 3*b* must be greater, in absolute value, than the supply voltage $V_{DD}$ plus the threshold voltage $V_{th}$ of the transistor 350.

Of course, according to the embodiment used for the control module 3, the switching means K10 are operated differently reacting in certain cases to a voltage rise and in other cases, to a voltage drop.

In an embodiment not shown, the control module 3 further comprises a peak-limiting device, for example based on diodes, connected to the output of the control module 3 so as to limit the deviation of the voltage of the control signal $V_{OUT}$.

In another embodiment, the pull-down resistor R0 connecting the output of the control module 3 to earth 300, or the pull-up resistor R10 connecting the output of the control module 3 to the supply voltage $V_{DD}$ may be replaced by a voltage divider bridge, the control signal $V_{OUT}$ being produced as output from the voltage divider bridge, so as to limit the deviation of the voltage of the control signal $V_{OUT}$.

FIG. 4 represents an embodiment of the control module 3 in which the energy threshold value $V_{threshold}$ is generated from the energy recovery signal $V_{RF}$.

This embodiment of the control module 3 has the advantage of not requiring the presence of the supply voltage $V_{DD}$ provided by the energy source 1.

In this embodiment, the comparing means 3*c*' comprise a PMOS type transistor 310 connected by its source to the output of the energy recovery module 3*b*, the output being at the output of the DC filter 31, by means of a first terminal 310*a*. The control signal $V_{OUT}$ output from the control module 3 is taken at a second terminal 310*b* of the drain of the PMOS transistor 310.

The energy threshold value is represented by a voltage Vs applied to the gate 310*g* of the transistor 310 plus the threshold voltage value $V_{th}$ or voltage for making the PMOS transistor 310 conduct.

The voltage applied to the gate 310*g* of the transistor 310 is generated by a voltage divider bridge 302 disposed between the output of the energy recovery module 3*b* and the earth 300.

The divider bridge is formed by a first resistor Rc1 mounted between the output of the DC filter 31 and the gate 310*g* of the transistor 310 and a second resistor Rc2 mounted between the output of the DC filter 31 and the earth 300.

When the voltage between the source 310*a* and the gate 310*g* of the PMOS transistor 310 attains the threshold voltage value $V_{th}$ or voltage for making the PMOS transistor 310 conduct, the PMOS transistor 310 becomes conducting and the control signal $V_{OUT}$ is equal to the energy recovery signal $V_{RF}$.

When the voltage between the source 310*a* and the gate 310*g* of the PMOS transistor 310 is less than the threshold voltage $V_{th}$ or voltage for making the PMOS transistor 310 conduct, the control signal $V_{OUT}$ is equal to the reference potential or ground 300.

It will be noted that the control module 3 described does not receive an electrical supply from the energy source 1 of the electronic detonator 100.

In an embodiment not shown, a peak-limiting module, of Zener diode type for example, may be mounted upstream of the comparing means 3*c*, 3*c*' so as to limit the maximum potential of the control signal $V_{OUT}$.

Of course, the comparing means may be different from those represented in FIGS. 3A and 3B. For example, other types of transistor could be used.

Figure 5A:
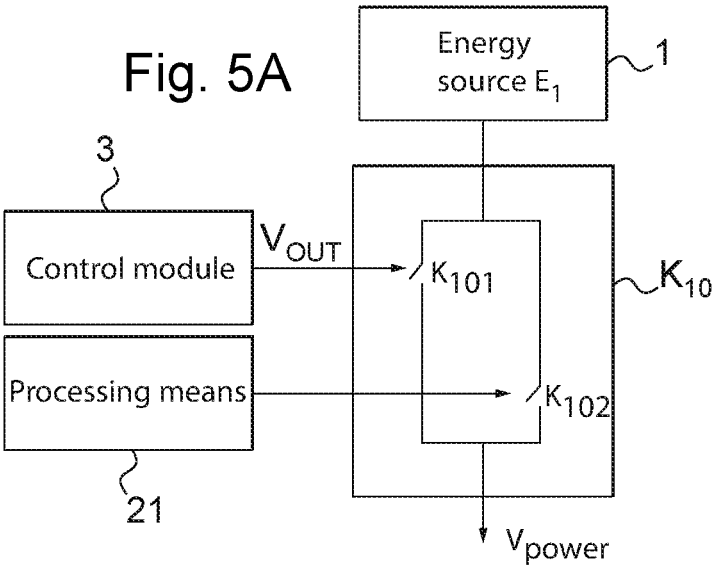
FIGS. 5A to 5C are block diagrams illustrating different embodiments of the switching means implemented in a wireless electronic detonator in accordance with the invention.
Figure 5B:
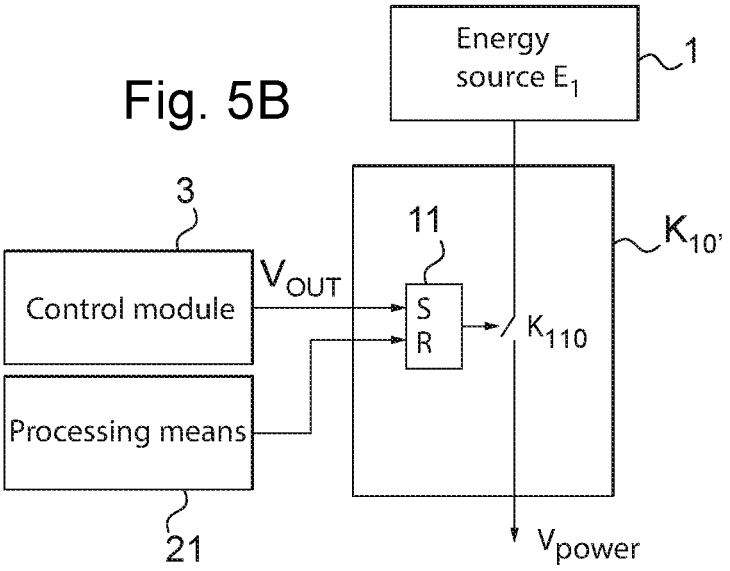
Figure 5C:
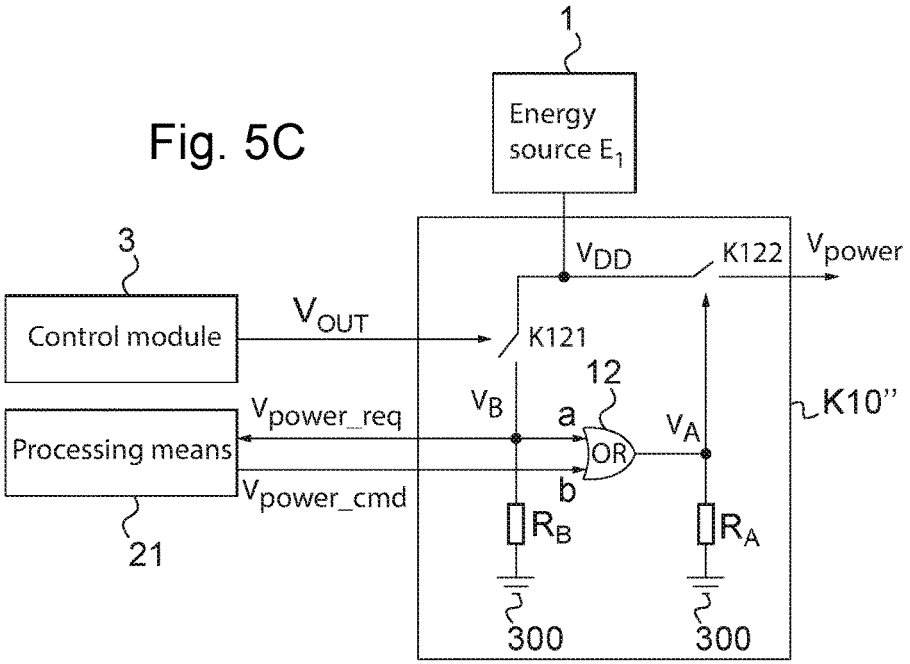

FIG. 5A to 5C represent different embodiments of the switching means K10.

FIG. 5A represents a first embodiment of the first switching means K10 or activating/deactivating mechanism. The first switching means K10 comprise a first switch K101 and a second switch K102.

The first switch K101 is controlled by the control signal $V_{OUT}$ output from the control module 3. The second switch K102 is controlled by the processing means 21 belonging to the functional modules 2.

By default, when the functional modules 2 of the electronic detonator 100 are electrically de-energized, the first and second switches K101, K102 are open.

When a control signal $V_{OUT}$ output from the control module 3 is generated with sufficient voltage, the first switch K101 is operated into an active state or closed position, causing the electrical energizing of the functional modules 2 of the electronic detonator 100.

It will be noted that the processing means 21 are thus electrically energized.

It is understood that the control signal $V_{OUT}$ is generated with sufficient voltage when the level of the recovered energy is such that the control module generates a control signal of a level such that the switching means K10 are activated, that is to say that they are in a position such that the functional modules 2 are electrically energized.

The electrically energized processing means 21 are able to take charge of the control of the first control means K10, in particular they are able to operate the second switch K102.

Thus, the processing means 21 are able to operate the second switch K102 into closed position or into activated state in order to maintain the functional module 2 energized, or in open position or deactivated state in order to electrically de-energize the functional modules 2.

It will be noted that so long as the functional modules 2 are not electrically energized, that is to say so long as the first switch K101 is not operated into closed position, the processing means 21 are inactive.

It will furthermore be noted that the processing means 21 operate the second switch K102 into closed position before the first switch K101 opens. As a matter of fact, when the receiving means 3*a* receive a signal and the energy recovery module recovers sufficient energy to operate the first switching means K101 into an active state, for example when a control console is sufficiently close to the electronic detonator 100, the first switch K101 is activated. The taking over by the processing means 21 operating the second switch K102 into closed position enables the functional modules 2 to continue to be supplied, that is to say that their electrical supply is maintained.

When the receiving means 3*a* does not receive a signal, for example when the control console is far from the electronic detonator, and the control module 3 cannot recover the energy required to maintain the first switch K101 in active state, the electrical supply is maintained only if the second switch K102 has been operated into closed position by the processing means 21.

Thus, in practice, when the control console moves away from the electronic detonator 100, the first switch K101 passing to an open position, the processing means 21 maintain the electrical supply of the functional modules 2 by operating the second switch K102 into closed position.

Furthermore, in order to cut off the electrical supply of the functional modules 2, the processing means 21 activate the second switch K102 into open position, the first switching means K10 thus returning to the default state.

In a variant of these embodiments, the switching means comprise a single switch operated by a signal suitably combining the control signal from the control module 3 and from the processing means 21. By way of example, an embodiment comprising a single switch will be described with reference to FIG. 5B.

FIG. 5B represents first switching means K10' according to a second embodiment.

In this embodiment, the switching means K10' comprise a switch K110 as well as a logic unit 11 combining the control signals coming from the control module 3 and from the processing means 21 and generating a signal operating the switch K110.

The logic unit 11 is for example an SR latch. The control signal $V_{OUT}$ of the control module 3 is connected to a first input "S" ("Set") of the SR latch 11 and the output of the processing means 21 are connected to a second input "R" ("Reset") of the SR latch 11.

By default, when the functional modules 2 of the electronic detonator 100 are electrically de-energized, the switch K110 is in open position.

When a sufficient voltage is recovered at the output of the control module 3, the SR latch 11 stores the fact that the threshold of recovered electrical energy has been passed over, and the signal generated at the output of the SR latch 11 activates the switch K110 into closed position, the functional modules 2 of the electronic detonator being thereby electrically supplied.

The switch K110 remains in closed position until the processing means 21 activate the electrical de-energizing of the functional modules 2.

To put the functional modules 2 back to being electrically de-energized, the processing means 21 activate the second input "R" of the SR latch 11, generating as output a signal activating the switch K110 into open position, the switching means K10' thus returning into the state by default.

FIG. 5C represents a third embodiment of the switching means K10"

The switching means K10" comprise a first switch K121 controlled by the control signal $V_{OUT}$ output from the control module 3, an "OR" type logic gate 12 and a second switch K122 controlled by the output of the logic gate 12.

When the second switch K122 is in closed position, the functional modules 2 of the electronic detonator 100 are electrically supplied, the second switch K122 being controlled by a potential $V_A$ generated as output from the logic gate 12. In this embodiment, the logic gate 12 comprises a first input a and a second input b. The first input signal a of the logic gate 12 represents a potential $V_B$ and the second input signal b of the logic gate 12 represents a potential $V_{power_cmd}$ coming from the processing means 21.

Furthermore, the "pull-down" resistors $R_A$, $R_B$ respectively connect the points of potential $V_B$ and $V_A$ to the earth 300.

When the potential $V_A$ is in the low state, the second switch K122 is in open position. The functional modules 2 are then electrically de-energized.

In contrast, when the potential $V_A$ passes to the high state, the second switch K122 is in closed position, the functional modules 2 being electrically supplied.

The potential $V_A$ passes from the low state to the high state only if at least one voltage input to the logic gate 12 is itself in the high state.

The electrical energizing and de-energizing of the functional modules 2 takes place, according to one embodiment, in several steps.

By default, the functional modules 2 are electrically de-energized, the processing means 21 not being electrically supplied. The potential $V_{power_cmd}$ generated by the processing means 21 is in the low state. Furthermore, in the absence of reception by the receiving means 3*a* of a radio tele-supply signal, the first switch K121 is in open position, the potential $V_B$ then being at the low state, by virtue of the presence of the pull-down resistor $R_B$ connected to the earth 300.

It will be noted that to activate the second switch K122 to the closed state, at least one of the voltages $V_B$ or $V_{power_cmd}$ respectively at the first input a and at the second input b of the logic gate 12 must be in the high state to raise the potential $V_A$ to the high state.

Thus, when the control console approaches the electronic detonator 100 and the receiving means 3*a* receive a tele-supply signal, the voltage obtained as output (represented by the control signal $V_{OUT}$) from the control module 3 activates the first switch K121 into the closed state. The potential $V_B$ then passes to the high state, so making it possible to activate the second switch K122 into the closed state, the functional modules 2 thus being electrically supplied.

The processing means 21, once electrically supplied, take over the task of the electrical energizing and apply to themselves a high state on the potential $V_A$ by means of the signal $V_{power_cmd}$.

It will be noted that in the case of the control console moving away, there is no consequence on the electrical supply of the functional modules 2 of the electronic detonator 100. When the control console moves away, and no tele-supply signal is present in the electrical supply 3, the potential $V_B$ returns to the low state by virtue of the pull-down resistor $R_B$ but the potential $V_A$ is kept at the high state by means of the signal $V_{power_cmd}$.

According to one embodiment, if a control console again approaches the electronic detonator 100, the potential $V_B$ rises due to the presence of a tele-supply signal. This rise in the potential $V_B$ is detected by the processing means 21, via the signal $V_{power_req}$. The processing means 21 then control the potential $V_{power_cmd}$ into the low state.

Thus, when the control console is again far from the electronic detonator 100, the potentials $V_B$ and $V_{power_cmd}$ at the inputs a, b of the logic gate 12 are in the low state, the functional modules 2 thus being electrically de-energized.

It will be noted that in this embodiment, this new coming closer of the control console generates electrical de-energizing of the functional modules 2 of the electronic detonator 100.

In a variant of this embodiment, in which a new coming closer of the control console generates the electrical de-energizing of the functional modules 2, a minimum delay may be provided between a prior activation and the electrical de-energizing of the functional modules 2 generated by a new coming closer of the control console.

Thus, if the new coming closer of the control console occurs before the minimum delay has elapsed, this new coming closer is not taken into account. This avoids inadvertent activations and deactivations of the electronic detonator when the control console is situated near the electronic detonator.

This embodiment makes it possible to electrically de-energize the functional modules 2 by again approaching a control console, once the functional modules 2 have already been electrically energized in advance.

Furthermore, in the absence of a control console nearby, the processing means 21 are able to activate the electrical de-energizing of the functional modules 2, by themselves commanding the potential $V_{power_cmd}$ into the low state in order to position the second switch K122 in an open state.

Figure 6A:
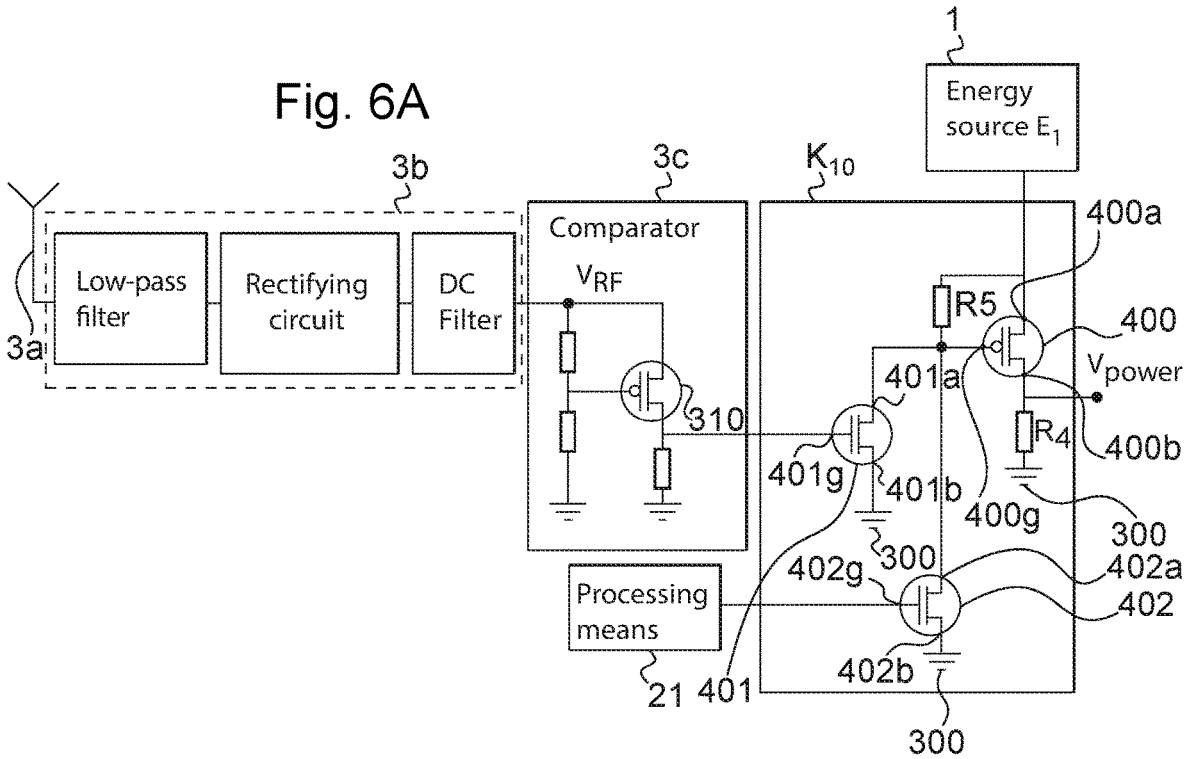
FIGS. 6A and 6B represent diagrams at transistor level illustrating the mechanism for activating and deactivating the switching means according to different embodiments.

FIG. 6A represents the control module 3 of FIG. 4 with switching means K10 or activation/deactivation mechanism represented at transistor level. This diagram is described on the basis of being in no way limiting. Other circuit diagrams implementing the same functions could be used and are within the capability of the person skilled in the art.

In this embodiment, the switching means K10 comprise a transistor 400 of PMOS type forming a switch mounted between the energy source 1 and the functional modules 2 (of which only the processing means 21 are represented in this Fig.).

In this embodiment, the transistor 400 is connected by its source 400*a* to the energy source 1 and by its drain 400*b* to a pull-down resistor R4 itself connected to the earth 300. The drain 400*b* of the transistor 400 is connected to the functional modules 2 so as to electrically supply them when the transistor 400 is in the closed state.

The switching means K10 further comprise a first transistor 401 of NMOS type and a second transistor 402 of NMOS type. The first NMOS transistor 401 controls the PMOS transistor 400, this first NMOS transistor 401 being controlled by the control signal $V_{OUT}$ generated by the control module 3, in particular by the output signal of the comparing means 3*c*. The second NMOS transistor 402 also controls the PMOS transistor 400, this second transistor being controlled by a control signal generated by the processing means 21.

The control signal $V_{OUT}$ output from the control module 3 is applied to the gate 401*g* of the first NMOS transistor 401. The control signal generated by the processing means 21 is applied to the gate 402*g* of the second NMOS transistor 402. The drain 401*a* of the first NMOS transistor 401 and the drain 402*a* of the second NMOS transistor 402 are connected to the gate 400*g* of the PMOS transistor 400. The source 401*b* of the first NMOS transistor 401 and the source 402*b* of the second NMOS transistor 402 are connected to the earth 300.

A resistor R5 connects the gate 400*g* and the source 400*a* of the PMOS transistor 400.

It will be noted that the PMOS transistor 310 of the comparing means 3*c* is referenced relative to $V_{RF}$ and the PMOS transistor 400 is referenced relative to the supply voltage $V_{DD}$. The first NMOS transistor 401 enables the control of the switch-forming PMOS transistor 400.

The operation of the diagram shown in FIG. 6A is described below.

By default, the first NMOS transistor 401 and the second NMOS transistor 402 are in open state, this being the case so long as no electrical energy coming from the radio signal sufficient to activate the switching means K10 is recovered.

When sufficient electrical energy coming from the radio signal has been recovered, the control signal $V_{OUT}$ activates the closing of the first NMOS transistor 401, the PMOS transistor 400 thus being activated to close, and the functional modules 2 thus being electrically supplied.

Once the functional modules 2 are electrically supplied, the processing means 21 are able to maintain or cut the electrical energizing of the functional modules 2.

For example, the processing means 21 maintain or cut the electrical supply as a function of the verification of certain conditions, such as the level of electrical energy recovered as output from the energy recovery module, or the duration of the presence of an energy recovery signal, or the validation of a frame received by the wireless communication means 20 in the functional modules 2.

When the processing means 21 activate the maintenance of the electrical supply, they activate the closing of the second NMOS transistor 402, resulting in maintaining the PMOS type transistor 400 in closed state, this being so even if no electrical energy is recovered by the energy recovery module 3*b* and the first NMOS transistor 401 passes back to open state.

The pull-up resistor R5 ensures the opening of the PMOS transistor 400, and therefore of the switching means K10, when the NMOS transistors 401, 402 are in the open state.

Figure 6B:
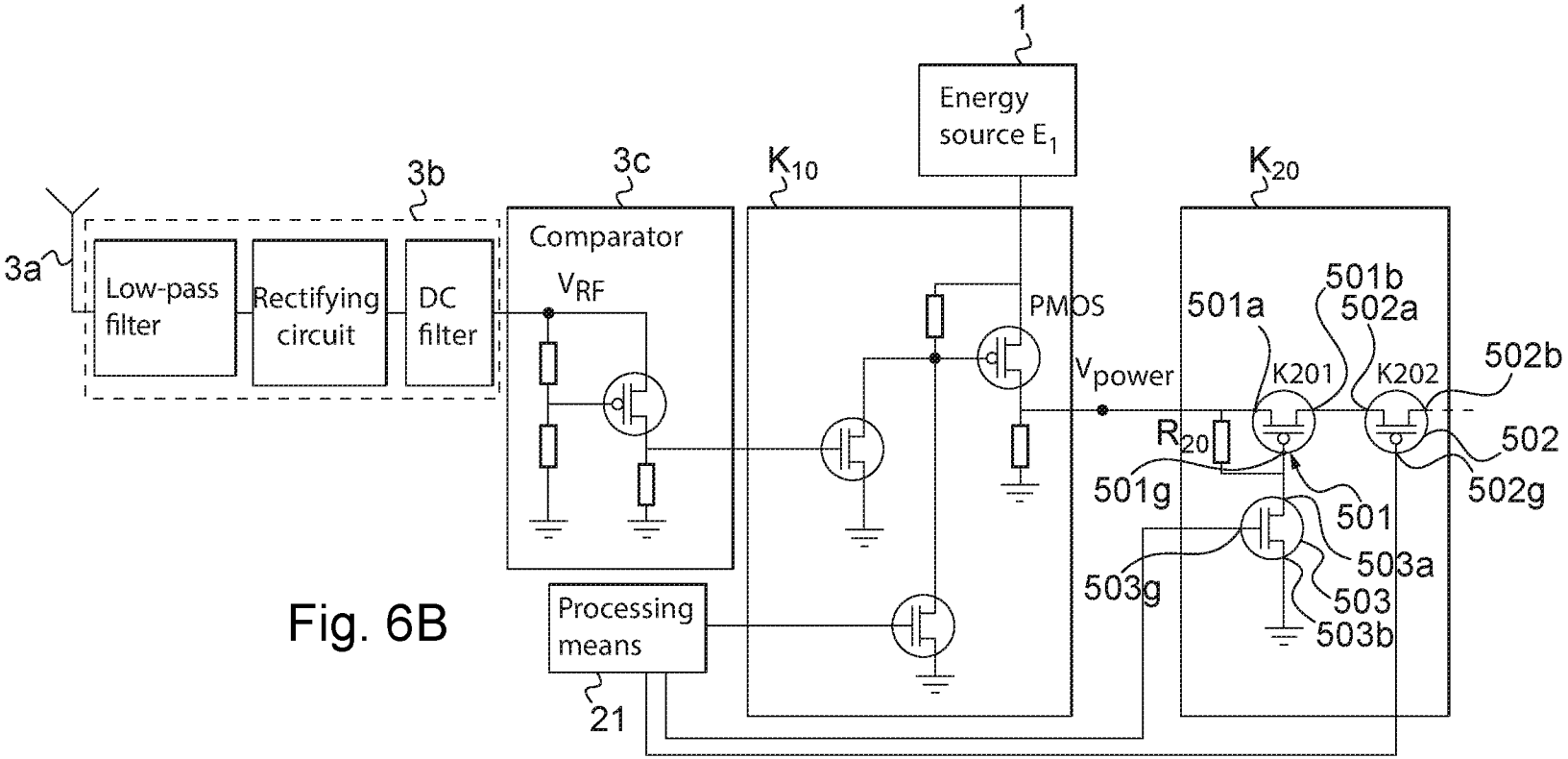

FIG. 6B represents the diagram of FIG. 6A to which the second switching means K20 have been added.

The second switching means K20 are mounted between the first switching means K10 and the energy storage module 22 (which can be seen in FIG. 1).

The second switching means K20 are operated by the processing means 21.

The second switching means K20 comprise, in this embodiment, a first PMOS transistor 501 forming a first switch K201, and a second PMOS transistor 502 forming a second switch K202.

The second switching means K20 further comprise an NMOS type transistor 503 providing the control of the first PMOS transistor 501 forming the first switch K201.

It will be noted that the first PMOS transistor 501 forming the first switch K201 is activated into the active state with a low state on its gate 501*g*.

If this PMOS transistor 501 were to be activated directly by the processing means 21, and not by the NMOS transistor 503, there would be a risk of the second switching means K20 being accidentally closed, for example during establishment of the supply voltage by the processing means.

Thus, in order to avoid this risk, the NMOS transistor 503 is present in order to provide, indirectly, active control over a high state of the first PMOS transistor 501 forming the first switch K201. Thus, when the gate 503*g* of the NMOS transistor 503 is in the high state, the NMOS transistor 503 is in the closed state, so causing the gate 501*g* of the PMOS transistor 501 to be brought to the low state, leading the PMOS transistor 501 to the closed state.

The second PMOS transistor 502 is mounted in series with the first transistor 501, the state of the second PMOS transistor 501 being controlled by the processing means.

In this embodiment, the first PMOS transistor 501 is connected by its source 501*a* to the output of the first switching means K10 and by its drain 501*b* to the source 502*a* of the second PMOS transistor 502. The drain 502*b* of the second PMOS transistor 502 represents the output from the second switching means K20, this output being connected to the energy storage module 22. The gate 501*g* of the first PMOS transistor 501 is connected to the drain 503*a* of the NMOS transistor 503, its source 503*b* being connected to the earth 300.

Control signals generated by the processing means 21 are applied respectively to the gate 503*g* of the NMOS transistor 503 and the gate 502*g* of the second PMOS transistor 502.

A pull-up resistor R20 connects the gate 501*g* and the source of the first PMOS transistor 501. This pull-up resistor R20 provides the opening of the second switching means K20 when the NMOS transistor 503 is in the open state.

It will be noted that in the described diagram, when the processing means 21 activate the transfer of energy to the energy storage module 22, that is to say that they activate the second switching means K20 into a closed state, the processing means 21 must, at the same time, supply the control signal activating the NMOS transistor 503 into the high state, and the control signal activating the second PMOS transistor 502 forming the second switch K202 into the low state.

This embodiment makes it possible to make the use of the electronic detonator 100 safer, since an accidental activation of the energy transfer to the energy storage module 22 is avoided. An accidental activation cannot thus take place, for example, in the event of an electromagnetic disturbance effect on the control of the first transistor 501 or the effect of a common mode potential on the electrical supply of processing means 21, or a failure in one of the two aforementioned outputs of the processing means 21.

The second switching means K20 can be implementing by other circuit layouts performing the same function, that is to say to enable the transfer of energy from the energy source 1 to the energy storage module 22 or to prevent such energy transfer.

For example, in another embodiment not shown, the second switching means K20 only comprise the first PMOS transistor 501 forming the first switch K201 and the NMOS transistor 503 controlling the first PMOS transistor 501.

Figure 7A:
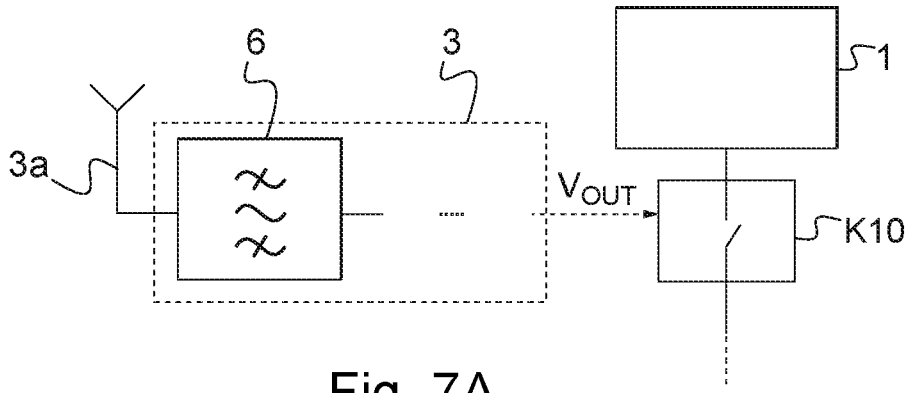
FIGS. 7A and 7B are block diagrams illustrating example embodiments of a control module used in the wireless electronic detonator in accordance with the invention.
Figure 7B:
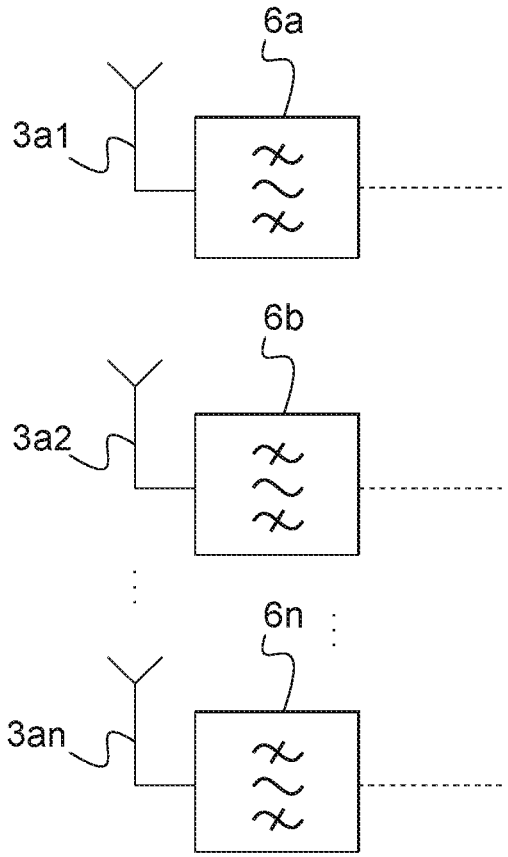

FIGS. 7A and 7B represent other possible embodiments of the control module.

In the embodiment represented in FIG. 7A, the control module 3 comprises filtering means 6, for example band-pass filtering means, mounted downstream of the receiving means 3*a*.

The band-pass filtering means 6 allow radio signals to pass that are received in a frequency band predefined by the filtering means 6.

The band-pass filtering means 6 are for example tuned to a frequency band used by the control console. Thus, the radio signals received by the receiving means 3*a* are filtered by the band-pass filtering means 6, limiting the possibility of activating the switching means K10 with some device other than the control console.

FIG. 7B represents a variant of the embodiment represented by FIG. 7A.

In this embodiment, the control module 3 comprises several receiving means 3*a*1, 3*a*2, . . . , 3*an*, and several filtering means, for example band-pass filtering means, 6*a*, 6*b*, . . . , 6*n* respectively mounted downstream of the receiving means 3*a*1, 3*a*2, . . . , 3*an*.

The band-pass filtering means 6*a*, 6*b*, . . . , 6*n* respectively allow to pass radio signals received in predefined frequency bands. Thus, each band-pass filtering means 6*a*, 6*b*, . . . , 6*n* is configured to filter the radio signals received in a frequency band, it being possible for the frequency bands to be different or equal for the different filtering means 6*a*, 6*b*, . . . , 6*n*.

According to another variant, the control module 3 comprises a single receiving means 3*a* followed by several filtering means 6*a*, 6*b*, . . . , 6*n*.

Of course, the number of receiving means and filtering means can be variable. Generally, the control module 3 may comprise a number N of receiving means and a number M of filtering means, wherein the number M is greater than or equal to N.

In the represented embodiments, the filtering means 6*a*, 6*b*, . . . , 6*n* are band-pass filtering means. Of course, other types of filter may be used.

In this embodiment, the control module 3 may further comprise verifying means configured to verify conditions relative to the reception of the signals by the receiving means 3*a*1, 3*a*2, . . . , 3*an*.

For example, the verifying means may be configured to verify the presence of an output signal from the totality of the filtering means 6*a*, 6*b*, . . . , 6*n* so as to verify whether there is a simultaneous reception of a signal in all the frequency bands considered.

In this example embodiment, the control signal $V_{OUT}$ is generated so as to activate the switching means K10 when a signal is present as output from the totality of the filtering means 6*a*, 6*b*, . . . , 6*n*.

In another example embodiment, it may be verified whether a temporal sequence of energy provision over each of the frequency bands considered is complied with.

For this, the control module 3 comprises verifying means configured to check the order of reception of the radio signals received as output from the filtering means 6*a*, 6*b*, . . . , 6*n*.

In this embodiment, the control signal $V_{OUT}$ is generated so as to activate the switching means K10 when a predefined instruction is verified by the verifying means.

According to another example embodiment, it may be verified for each of the band-pass filtering means 6*a*, 6*b*, . . . , 6*n* whether a signal is present or on the contrary whether no signal is present as output, the signal presences and/or absences forming a predefined logic combination. When a predefined logic combination formed by the signal presences and absences is verified, the control signal $V_{OUT}$ is generated such that the switching means are activated.

It will be noted that a signal is considered as present when it exceeds a predetermined value, such as the energy threshold value. On the contrary, it is considered as absent when the signal level does not exceed the predetermined value.

The verifying means described above may form part of a processing unit 3*d* such as that represented in FIG. 2B.

According to other embodiments, the conditions described above concerning the verification of frequencies of the radio signals received may be verified by the processing means 21 in the functional modules 2 once the switching means K10 have been activated and the functional modules 2 are electrically supplied.

Thus, the verification of the frequency conditions would correspond to a condition for maintaining the electrical supply once the electrical energizing of the functional modules 2 has been implemented.

As described above in relation with the wireless electronic detonator 100, the wireless electronic detonator 100 in accordance with the invention is activated, that is to say electrically energized in order to be put into operation, according to an activation method comprising the following steps:

receiving S1 a radio signal, recovering S2 electrical energy from said received radio signal, generating S3 an energy recovery signal ($V_{RF}$) representing the level of energy recovered, and generating S4 a control signal ($V_{OUT}$) generated according to said recovered energy, said control signal controlling said first switching means (K10) so as to make it possible to connect the energy source to the functional modules.

Figure 8:
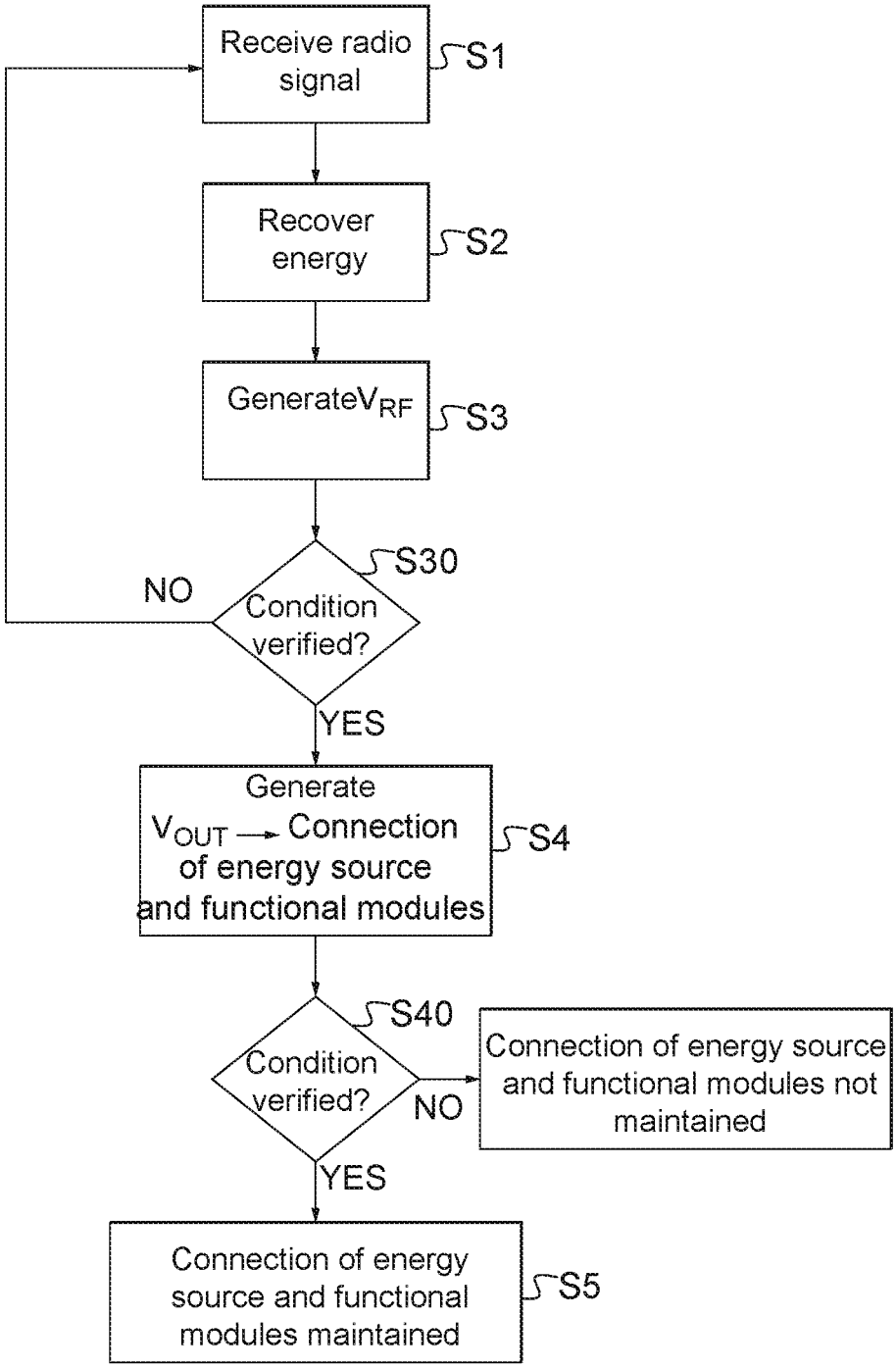
FIG. 8 illustrates steps of the method of activating a wireless electronic detonator in accordance with an embodiment.

FIG. 8 represents steps of the method of activating an electronic detonator according to an embodiment.

The received radio signal is considered as a tele-supply signal, since it enables the activation of the first switching means K10 and thus the electrical supply of the functional modules 2.

Of course, when reference is made to the first switching means K10 in this document, different embodiments of the first switching means K10, such as those described with reference to FIGS. 5A, 5B and 5C may equally well be used.

According to a practical implementation of the activation of a wireless electronic detonator 100, an operator with a control console approaches the wireless electronic detonator 100 in order to electrically energize the functional modules 2 of the electronic detonator 100.

To avoid possible inadvertent or accidental electrical energizing, it is necessary to provide conditions for the electrical energizing or activation and/or for maintaining the electrical supply further to the electrical energizing of the functional modules 2, in particular further to the activation of the first switching means K10.

Thus, it is necessary to provide conditions for immediate maintenance of the voltage further to the electrical energizing of the functional modules 2.

Furthermore, to return to a state of safety, for example further to an aborted firing for example, the invention provides conditions for maintaining the voltage (or conversely, for electrical de-energizing) in nominal mode, that is to say once the wireless electronic detonator 100 has been supplied durably by its own energy source 1.

It will be noted that according to embodiments, conditions are verified at a verifying step S30 to electrically energize or not electrically energize the electronic detonator 100 and/or conditions are verified at a second verifying step S40 to maintain or not maintain the electrical supply of the electronic detonator once it has been electrically energized.

In order to satisfy the various strategies for deployment of the network of detonators (detailed later), at least one of several conditions may be verified for the immediate maintenance of the electrical energizing of the functional modules 2:

conditions as to the tele-supply signal, for example as to the level of electrical energy recovered, the duration of presence, a sequence of presences of the radio signals output from the various receiving means to comply with, or a logic combination of the presences or absences of the radio signals output from the various receiving means, as described above;

validation of a condition for pairing with the control console. By pairing is meant an identification procedure enabling the control console to communicate with the desired electronic detonator;

exchange of one or more predefined radio messages with the control console.

It will be noted that, according to the embodiments implemented, the conditions for immediate maintenance of the voltage are analyzed while the electronic detonator 100 is tele-supplied, that is to say while the functional modules 2 are electrically energized on account of the activation of the first switching means K10 by the control module 3. For this, the control console must be kept near the electronic detonator 100 during this time.

According to other embodiments, the electrical energizing of the functional modules 2 is maintained before verifying the conditions for maintenance. At least one of the conditions for maintenance is then verified, within a reasonably short time limit, typically of a few seconds. In these embodiments, there is no constraint as to the positioning of the control console during verification of the conditions for maintenance.

Once the functional modules 2 are supplied by the energy source 1, and the control console is no longer in the close neighborhood of the electronic detonator 100, the electronic detonator 100 operates in nominal mode. It is important for the electrical de-energizing of the functional modules 2 to be carried out remotely and autonomously by the electronic detonator 100 in order to avoid any intervention by an operator near the network of electronic detonators.

The electrical de-energizing of the functional modules 2 is operated by the processing means 21.

The electrical de-energizing is activated further to at least one verification concerning the internal state of the electronic detonator 100 or concerning information coming from outside the electronic detonator 100.

For example, electrical de-energizing is activated when an anomaly internal to the electronic detonator 100 is detected.

The electrical de-energizing may also be activated by an explicit instruction from the control console, upon detection of a period of radio inactivity of the control console considered by the electronic detonator 100 as being abnormally long, or upon detection of a period of non-solicitation by the control console considered by the electronic detonator as being long.

As described above, in some embodiments of the electronic detonator 100, the electrical de-energizing of the functional modules 2 of the electronic detonator can also be achieved upon detection of the control console nearby. Thus, for example, an operator can manually turn off the electrical supply of the electronic detonator 100 after having electrically energized it. An electronic detonator enabling this comprises for example first switching means K10" such as described with reference to FIG. 5C.

Thus, according to one embodiment, the method comprises, prior to said generating S4 of the control signal, verifying S30 a condition relative to the received radio signal or relative to the level of electrical energy recovered from said radio signal.

According to another embodiment, the method comprises, after said generating S4 of the control signal, verifying S40 a condition relative to the received radio signal or relative to the level of electrical energy recovered from said radio signal.

The method further comprises, after said generating S4 of the control signal, a step S5 of maintaining the first switching means k10 operated so as to make it possible to connect the energy source 1 to the functional modules 2 according to the result of said verification.

According to embodiments, the verification comprises comparing the level of an energy recovery signal representing the level of electrical energy recovered with an energy threshold value $V_{threshold}$. The first switching means K10 are thus operated so as to make it possible to connect the energy source 1 to the functional modules 2 when said level of the recovered energy is greater than or equal to the energy threshold value $V_{threshold}$.

According to some embodiments, the verification may thus comprise determining the time of presence of the received radio signal. When the time of presence determined is greater than or equal to a predefined period of time, the first switching means K10 are operated so as to make it possible to connect the energy source 1 to the functional modules 2.

According to some embodiments, the verification comprises determining the frequency of the radio signal received by the receiving means. When the received radio signal is present in a predefined frequency band, the first switching means K10 are operated so as to make it possible to connect the energy source 1 to the functional modules 2.

The pairing may be implemented using different techniques. These techniques may be classified as techniques using radio technology and techniques using other technologies.

Those which use radio technology may consist:

in requiring proximity between the control console and the electronic detonator 100, for example the control of the emission power in the control console, through the choice of the frequency bands used, or through the choice of the type of modulation used, or in taking a suitable position relative to the electronic detonator 100 (directivity of the antenna 3*a* of the detonator and/or of the console, pointing of the antenna 3*a* of the detonator and/or of the console), or in evaluating the distance between the control console and the electronic detonator 100, for example by evaluating an appropriate radio technique (through the analysis of the travel time of the radio signal between the control console and the electronic detonator 100, or through the analysis of the power of the radio signal received by the electronic detonator 100 and/or by the console), or in discriminating between different communicators based on the analysis of their respective radio metrics (for example analysis of the travel time between the control console and the electronic detonator 100, or analysis of the power of the radio signal received by the console)

Examples of techniques which implement another technology are those:

using an optical reading method, for example a barcode, used afterwards for the radio communication, or compared with an identifier obtained by radio, using a light and/or sound and/or touch signal coming from the electronic detonator 100, analyzed for example by an operator, or using an estimation of the position carried out by the electronic detonator 100 itself (for example by GPS or by radiolocation relative to local beacons).

It will be noted that when the pairing procedure leads to obtaining responses from several distinct electronic detonators 100 and the pairing technique does not make it possible to reliably discriminate the desired electronic detonator 100, the information is notified to an operator via the control console, the latter then being able to take the appropriate decision (for example electrically de-energize the electronic detonators or withdraw the pairing procedure).

Once an electronic detonator 100 has been electrically energized, a delay for firing is associated with it. This association may be implemented immediately or after a time further to the electrical energizing.

According to various embodiments, the electrical energizing and the association of the delay may be carried out with the same control console or with different control consoles.

Thus, the deployment of the electronic detonators 100 may be carried out in different ways.

In case of immediate association of the delay, the electrical energizing of the electronic detonator 100 is carried out at the moment of its installation. Immediately after the electrical energizing, radio messages are exchanged between the electronic detonator 100 and the control console in order to perform the operation "immediate association of the delay" by validating that radio exchange through a pairing technique, for example one of the pairing techniques given above. The radio exchange and the result of the pairing constitute the conditions for immediate maintenance of the voltage of the electronic detonator 100. If one of these two operations fails, the electronic detonator 100 electrically de-energizes itself.

In case of immediate association of delay, but with different control consoles for the electrical energizing and the association of delay, the electrical energizing is carried out at the time of its installation, and the association of the delay is carried out in a second phase, once all the detonators 100 have been electrically energized. This leads to unconditionally validating the maintenance of the voltage of the functional modules 2, or at least to verifying the presence of the control console over a minimum duration (typically of the order of a few seconds). The processing means 21 may then, for example, enter a state of sleep or standby with a an operation of periodic wake-up, just after the electrical energizing, in order to save the energy source 1.

In case of differed association of the delay, the entirety of the electronic detonators 100 are first of all electrically energized at the time of their installation via the control console. Next, the electronic detonators 100 may be made to enter a state of sleep or standby with a procedure of periodic wake-up. Once all the electronic detonators 100 have been installed and electrically energized, delays are associated with all the electronic detonators 100. For this, the electronic detonators 100 are equipped with some or other location system (for example GPS, or a system measuring relative distances or received powers between each electronic detonator 100 of the network, possibly requiring a post-processing step, etc.). The raw data relative to each electronic detonator 100 (for example the absolute position, relative distances or received powers, etc.) are collected for example by radio with the control console, in order to produce a map of the network of the electronic detonators with their identifiers. Knowing this map, it is then possible to associate a delay with each electronic detonator 100.

An inconsistency observed between a planned firing layout and the real map of the electronic detonators 100 may be detected, enabling the electrical de-energizing of the detonators having that inconsistency.

When the electrical energizing and the association of the delay are carried out with different command consoles, these two operations are carried out at times spaced apart in time, ranging from a few minutes to several hours or even several days according to the case. Conditions for electrical de-energizing may be considered in the meantime to enable the electronic detonator 100 to return to an electrically de-energized state. For example, in case of non-solicitation by radio after a certain time limit, or without exchange or reception of messages with the control console at the time of the operations of periodic wake-up of the electronic detonator 100, the processing means may electrically de-energize the electronic detonator 100.

Ultimately, each of these approaches ends with the execution of a conventional firing procedure.

The invention claimed is:

1. A wireless electronic detonator comprising:

an energy source;

functional modules;

a first switch between the energy source and the functional modules, and operative to connect or not to connect the energy source to the functional modules; and a control module that controls the first switch, the control module comprising a radio energy recovery module configured to:

receive a radio signal coming from a control console, recover electrical energy in the received radio signal, generate an energy recovery signal ($V_{RF}$) representing the level of recovered electrical energy, and generate a control signal ($V_{OUT}$) according to the recovered electrical energy, the control signal ($V_{OUT}$) controlling the first switch.

2. The wireless electronic detonator according to claim 1, wherein the control module further comprises a comparator that compares a level of the energy recovery signal ($V_{RF}$), with an energy threshold value ($V_{threshold}$), the control signal ($V_{OUT}$) being generated, such that the first switch connects the energy source to the functional modules when the level of the energy recovery signal ($V_{RF}$) passes over the energy threshold value ($V_{threshold}$).

3. The wireless electronic detonator according to claim 2, wherein the energy threshold value ($V_{threshold}$) is obtained from the energy source.

4. The wireless electronic detonator according to claim 2, wherein the energy threshold value ($V_{threshold}$) is obtained from the energy recovery signal ($V_{RF}$).

5. The wireless electronic detonator according to claim 2, wherein the energy threshold value ($V_{threshold}$) is equal to a value outside a range of operating potentials of the energy source.

6. The wireless electronic detonator according to claim 2, wherein a part of the control module is referenced in relation to a reference potential ($V_{ref}$) equal to a value in a range of operating potentials of the energy source.

7. The wireless electronic detonator according to claim 1, wherein the control module further comprises means for verifying a time of presence of the energy recovery signal ($V_{RF}$) exceeding a predetermined value, the control signal ($V_{OUT}$) being generated, such that the first switch connects the energy source to the functional modules when the time of presence is greater than or equal to a predefined period of time.

8. The wireless electronic detonator according to claim 1, wherein the control module comprises at least one receiver receiving one or more radio signals from a control console and at least one filter mounted downstream of the at least one receiver, the at least one filter allowing the one or more radio signals to pass over predefined frequency bands.

9. The wireless electronic detonator according to claim 8, wherein the control module further comprises verifying means configured to verify the presence of a signal as an output from the at least one filter, the control signal ($V_{OUT}$) being generated such that the energy source is connected to the functional modules when a signal is present as an output from the at least one filter.

10. The wireless electronic detonator according to claim 8, wherein the at least one filter comprises several filters and verifying means that are configured to verify an order of reception of one or more signals output respectively from the several filters, the control signal ($V_{OUT}$) being generated such that the energy source is connected to the functional modules when a predefined instruction is verified.

11. The wireless electronic detonator according to claim 8, wherein the at least one filter comprises several filters and verifying means that are configured to verify the presence or the absence of a signal as an output respectively from the several filters and to generate as a result a combination of presences and absences, the control signal ($V_{OUT}$) being generated such that the energy source is connected to the functional modules when a predefined combination of presences and absences is verified.

12. The wireless electronic detonator according to claim 1, wherein the control module further comprises verifying means for verifying a frequency of the received radio signal, the control signal ($V_{OUT}$) being generated such that the switch connects the energy source to the functional modules when the radio signal is present in a predefined frequency band.

13. The wireless electronic detonator according to claim 1, wherein the functional modules comprise a processor that controls the first switch.

14. The wireless electronic detonator according to claim 13, wherein the processor controls the first switch so as to keep the energy source connected beforehand to the functional modules or not to maintain the energy source connected to the functional modules.

15. The wireless electronic detonator according to claim 14, wherein the processor controls the first switch so as to maintain the energy source connected to the functional modules if a level of electrical energy recovered by the energy recovery means is greater than or equal to a predefined energy threshold value.

16. The wireless electronic detonator according to claim 14, wherein the processor controls the first switch so as to maintain the energy source connected to the functional modules if the duration of presence of electrical energy recovered by the energy recovery module and that passes over a predetermined value exceeds a predefined period of time.

17. The wireless electronic detonator according to claim 14, wherein the processor controls the first switch so as to maintain the energy source connected to the functional modules if the received radio signal is present in a predefined frequency band.

18. The wireless electronic detonator according to claim 1, wherein functional modules comprise an antenna, a processor, an energy storage module, an explosive squib, and second and third switches, the second switch between the first switch and the energy storage module, and the third switch between the energy storage module and the explosive squib, the antenna connected to the processor, the processor controlling the first, second and third switches.

19. A wireless detonating system comprising the wireless electronic detonator according to claim 1, and a control console configured to emit radio signals to the wireless electronic detonator.

20. A method of activating a wireless electronic detonator comprising an energy source, functional modules and a first switch between the energy source and the functional modules and that are controlled by a control module, the method comprising:

receiving a radio signal, recovering electrical energy from the received radio signal, generating an energy recovery signal ($V_{RF}$) representing a level of energy recovered, and generating a control signal ($V_{OUT}$) according to the recovered energy, the control signal ($V_{OUT}$) controlling the first switch so as to connect the energy source to the functional modules.

21. The method according to claim 20, wherein the method further comprises, prior to generating the control signal ($V_{OUT}$), verifying a condition relative to the received radio signal or the energy recovery signal ($V_{RF}$).

22. The method according to, wherein the verification comprises comparing the level of the energy recovery signal ($V_{RF}$) representing the level of recovered electrical energy with an energy threshold value ($V_{threshold}$), the first switch being operated so as to maintain the energy source connected to the functional modules when a level of the energy recovery signal ($V_{RF}$) is greater than or equal to the energy threshold value ($V_{threshold}$).

23. The method according to claim 21, wherein the verification comprises determining a time of presence of electrical energy recovered from the received radio signal exceeding a predetermined value, the first switch being operated so as to maintain the energy source connected to the functional modules when a determined time of presence is greater than or equal to a predefined period of time.

24. The method according to claim 21, wherein the verification comprises verifying the presence of the radio signal received by a receiver in a predefined frequency band, the first switch being operated so as to maintain the energy source connected to the functional modules when the received radio signal is present in the predefined frequency band.

25. The method according to claim 20, further comprising, after generating the control signal ($V_{OUT}$), performing verification of a condition relative to the received radio signal or relative to the energy recovery signal ($V_{RF}$), and maintaining the first switch so as to maintain the energy source connected to the functional modules according to the result of the verification.

* * * * *